United States Patent [19]

Schimpf

[11] Patent Number: 5,004,590

[45] Date of Patent: Apr. 2, 1991

[54] CARBON FIBERS

[75] Inventor: Warren C. Schimpf, Wilmington, Del.

[73] Assignee: Hercules Incorporated, Wilmington, Del.

[21] Appl. No.: 520,785

[22] Filed: Aug. 5, 1983

[51] Int. Cl.[5] ..... D01F 9/12

[52] U.S. Cl. ..... 425/447.2; 423/447.1; 423/447.4; 423/447.6; 264/29.2; 264/29.7; 8/115.52

[58] Field of Search ..... 423/447.1, 447.4, 447.6, 423/447.2; 264/29.2, 29.7; 8/115.5

[56] References Cited

U.S. PATENT DOCUMENTS

| | | | |
|---|---|---|---|
| 3,656,904 | 4/1972 | Ram | 423/447.4 |
| 4,100,004 | 7/1978 | Moss et al. | 423/447.6 |
| 4,347,279 | 8/1982 | Saji et al. | 423/447.6 |

FOREIGN PATENT DOCUMENTS

| | | | |
|---|---|---|---|
| 748806 | 9/1970 | Belgium | 423/447.6 |
| 101648 | 11/1973 | Fed. Rep. of Germany | 423/447.4 |
| 49-00527 | 1/1974 | Japan | 423/447.1 |
| 51-06250 | 2/1976 | Japan | 423/447.1 |
| 57-21521 | 2/1982 | Japan | 423/447.1 |
| 57-25418 | 2/1982 | Japan | 423/447.1 |

OTHER PUBLICATIONS

Bacon, J. of Applied Physics, vol. 31, No. 2, pp. 283–290, Feb. 1960.

*Primary Examiner*—William R. Dixon, Jr.
*Assistant Examiner*—Chris Gallo
*Attorney, Agent, or Firm*—David Edwards

[57] ABSTRACT

Polyacrylonitrile (PAN)-based carbon fiber in the form of a filament bundle has a high Modulus and a high Tensile Strength in the Impregnated Strand Test respectively between about 42 million and 50 million psi and between about 600,000 and 900,000 psi, and Short Beam Shear Strength between about 15,000 and 19,000 psi in the Laminate Test; this PAN-based carbon fiber also has an electrolytically treated surface at 0.5 columbs per inch per approximate 12,000 filaments. The preparation of this PAN-based carbon fiber was accomplished by stretching during carbonization previously stretched and stabilized fine denier precursor while maintaining temperatures and heat up rates within certain ranges.

2 Claims, 10 Drawing Sheets

CARBON FIBERS

This invention relates to carbon fiber for use in providing structural composites containing a resinous matrix. This invention, more particularly, relates to a new carbon fiber that can impart unexpectedly high levels of both strength and stiffness to these composites.

As used herein, carbon fiber refers to filamentary material composed of practically all carbon, e.g. above 94% by weight, and suitable for incorporation into resinous matrices to provide structural composites.

Filamentary polyacrylonitrile precursors have been used over many years to manufacture carbon fibers. In manufacturing of carbon fiber having a modulus over forty (40) million psi, the prior art has proposed, for example, carbonization of the stabilized product of the precursor at temperatures above 2000° C. Carbonization at these high temperatures, however, has been found to render the surface of the resulting carbon fiber too inert for advantageous use in structural composites containing resinous matrices. Consequently, the surface of the high modulus carbon fiber is treated to activate it and thereby permit the carbon fiber to bond better to the resin matrix.

Unfortunately, the degree of conventional treatment necessary for activating the surface of the aforesaid high modulus carbon fiber is so high that other properties of the carbon fiber deteriorate, particularly tensile strength. Moreover, tensile strengths have never been especially high (e.g. over 600,000 psi) through ordinary processing, at least when the precursor has not been oxidized through chemical means. As a consequence, here has been no carbon fiber commercially available prior to that of this invention which has assuredly had a modulus over forty (40) million psi and a tensile strength over six hundred thousand (600,000) psi along with a capacity to transmit these properties in a resinous matrix (as evidenced by short beam shear strength).

Previous attempts at high modulus, high tensile strength carbon fiber are identified in the following abstracts and patents:

Japanese 76/6250 which recites a modulus of 38.5 million psi and tensile strength of 510 thousand psi as exemplary properties attainable from use of special denier polyacrylonitrile precursor; East German 101,648 which recites a modulus of 49.8 million psi modulus and 311 thousand psi strength carbon fiber made using stretching during oxidation and carbonization; and Japanese 49/0000-527 which recites a tensile strength of 668,000 psi and a modulus of about 39.1 million psi for carbon fiber made by exposing polyacrylonitrile to $KMnO_4$ or $K_2Cr_2O_7$, heating in air between 200°-300° C., immersing in HCl and heating in nitrogen at 1300° C.

Carbon fiber of this invention exhibits the following properties in an Impregnated Strand Test:

1. Modulus between 42 and 50 million psi;
2. Tensile Strength between 600 and 900 thousand psi;

and the following property in a Laminate Test:

3. Short Beam Shear Strength of between 15 and 19 thousand psi, and is further characterized by a density preferably between 1.70 and 1.85 gms/cc, a round cross section and a smooth surface. Also, the carbon fiber has a mean filament area between 15.8 and 33.3 square microns with coefficient of variation ($C_v$) of approximately five (5) percent or less. The Calculated Strain in the Impregnated Strand Test is between about 1.30 and 1.85. (Appendices A and B included at the end of this specification set forth procedures of the Impregnated Strand Test, the Laminate Test and other means used in characterizing carbon fiber described herein.)

Figure 1:
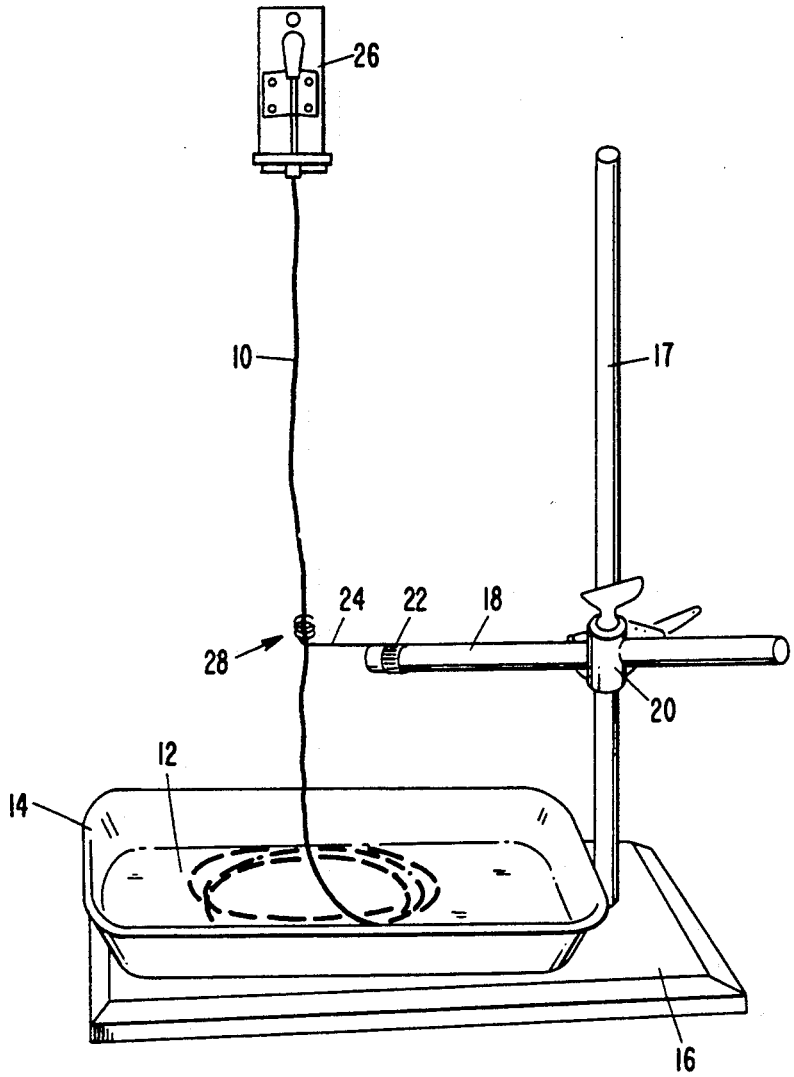
FIGS. 1-18 diagrammatically depict equipment identified in these procedures.

The carbon fiber of this invention has been accomplished by stretching a previously stretched and stabilized 0.65 to 0.95 denier polyacrylonitrile, starting material during controlled carbonization where the heat up rate for the fiber undergoing initial carbonization is between about 200° and 2000° C. per minute. Stretching during oxidation is between about 10 and 22% and during carbonization between about 1 and 20%.

Carbon fiber in accordance with this invention is preferably made as follows. Polyacrylonitrile based fiber, made from between about 85 and 98% by weight acrylonitrile and between about 15 and 2% of other monomers such as methacrylic acid, acrylic acid, methyl acrylate, and methyl methacrylate is preferably used as the starting material. The polyacrylonitrile starting material is in the form of bundles each comprising between about 3000 and 24000 filaments per bundle. The filaments have mean -average denier between about 0.65 and 0.95, more, preferably about 0.75–0.85 with 95% of the filaments being ±0.05 denier in each bundle. Preferably, the polyacrylonitrile starting material contains a silicone sizing such as depicted in GB 2059407 to improve its handling during manufacture of the carbon fiber. The preferred polyacrylonitrile starting material has a smooth surface, round cross section, an intrinsic viscosity of between about 1.5–2.5 deciliters per gram; in addition, it is made using an air gap wet spinning process.

In manufacture of the carbon fiber in accordance with this invention, the polyacrylonitrile starting material is first stabilized in air by passing it through one or more ovens for exposure to oxidizing conditions. Oxidation temperature in the oven(s) are between about 200° and 300° C., more preferably between about 220° C. and 260° C. One or more ovens, or multiple passes through one or more ovens may be employed during this stabilization of the fiber, each of the ovens having a maximum temperature within the ranges indicated above.

The oxidized starting material has a density between 1.31 and 1.38 grams per cubic centimeters after stabilization in the oxidation ovens, more preferably between about 1.36 and 1.37 grams per cubic centimeter.

The starting material is stretched during its initial oxidation, e.g. in the first oven, so that its length after stabilization is between about 110 and 122%, more preferably 115 and 119% its original length. Preferably, stretching is accomplished in the first few passes at oxidizing conditions in the initial oven.

After passing through the oxidation oven or ovens, the stretched, stabilized fiber is then passed through a low temperature furnace or furnaces followed by passage through a higher temperature furnace or furnaces. The low and high temperature furnaces contain an inert gas such as nitrogen. The maximum temperature of the stabilized fiber in the low temperature furnace or furnaces ranges between about 500° C. and 800° C., more preferably 650° and 750° C.

The low temperature furnace is purged of products issuing from the passing stabilized fiber undergoing carbonization. After leaving the low temperature furnace or furnaces, the fiber is then exposed to still higher maximum temperatures e.g. between about 1200° C. and 1800° C., more preferably 1250° C. and 1600° C. in the high temperature furnace or furnaces.

During passage through the low and high temperature furnaces the fiber is stretched so that its length is between about 1 and 20%, more preferably 1 and 15%, longer upon its exit as compared to what it was upon entry.

The heat up rate of the initial or low temperature furnace is between about 200° and 2000° C. per minute, where heat up rate is defined as the maximum temperature increase rates witnessed by the fiber as it passes through a furnace. The heat up rate of the high temperature furnace is between about 500° and 5000° C. per minute.

Residence time of the fiber commencing with initial oxidation to exit from the final high temperature furnace ranges between about one third hour to three hours.

After passage through the low and high temperature furnaces, the carbon fiber is surface treated. A variety of surface treatment approaches are available (see EP 579 492). Preferably the surface treatment comprises passing the carbon fiber through an aqueous ammonium bicarbonate bath wherein the carbon fiber receives between about 0.2 and 0.8 coulombs per inch of electrical charge.

Table A below characterizes carbon fiber which can be made in accordance with the above described processing conditions in terms of its physical and mechanical properties relative to embodiments 1 and 2 which are respectively further characterized in Examples 1 and 2, respectively. The properties set forth in Table A are determined in accordance with the procedures set forth in the Appendices entitles "Test Procedures."

TABLE A

| | Embodiment 1 |
|---|---|
| Density | 1.72–1.77 gr/cm$^3$ |
| Mean Filament Area | 19.8–24.5 sq. microns |
| Tow Test Properties | |
| Tensile Strength | 600,000–800,000 psi |
| Tensile Modulus | 42–47 million psi |
| Strain to Failure (Calculated) | 1.3–1.7% |
| Laminate Test Properties | 15,000–19,000 psi |
| Short Beam Shear Strength | |
| | Embodiment 2 |
| Density | 1.74–1.85 gr/cm$^3$ |
| Mean Filament Area | 16.0–28.3 sq. microns |
| Tow Test Properties | |
| Tensile Strength | 600,000–900,000 psi |
| Tensile Modulus | 42–50 million psi |
| Strain to Failure (Calculated) | 1.3–1.85% |
| Laminate Test Properties | 15,000–19,000 psi |
| Short Beam Shear Strength | |

EXAMPLE 1

Carbon fiber was made using the procedures previously described. The polyacrylonitrile starting material was 0.8 denier and made from monomers: acrylonitrile 98% and methacrylic acid 2%. The fiber had a silicone sizing agent. The fiber was stabilized by passing it through three oxidation ovens, the average temperatures of which were 228° C., 236° C. and 242° C., respectively. The stabilized fiber was then passed through low and high temperature furnaces respectively having average temperatures of 700° C. and 1450° C. The residence times in each of the oxidation ovens and low and high temperature furnaces were 45 minutes, 4 minutes, and 4 minutes, respectively. The carbon fiber exiting the high temperature furnace was surface treated in an ammonium bicarbonate bath with a charge of 0.5 coulombs per inch. The surface treated carbon fiber was sized with an epoxy compatible sizing agent. The sized carbon fiber had properties as shown in Table B below:

TABLE B

| | |
|---|---|
| Density | 1.74 gm/cm$^3$ |
| Weight/length | 26.1 lbs./in. $\times 10^{-6}$ |
| Mean Filament Area | 22.9 square microns |
| Tensile Strength[1] | 640 $\times 10^3$ psi |
| Tensile Modulus[1] | 40 $\times 10^6$ psi |
| Strain to Failure[1] | 1.5% |
| Flex Strength[2] | 235 $\times 10^3$ psi |
| Flex Modulus[2] | 21.9 $\times 10^6$ psi |
| Short Beam Shear Strength[3] | 17 $\times 10^3$ psi |

[1]Laminate Test, 100% Fiber Volume in 3501-5A epoxy resin of Hercules Incorporated.
[2]Laminate Test, 62% Fiber Volume in 3501-5A epoxy resin of Hercules Incorporated.
[3]Laminate Test, 3501-5A epoxy resin of Hercules Incorporated.

Table C below shows process conditions and results of carbon fiber prepared generally according to this Example using the identified Process Conditions to yield carbon fiber with the respective Physical and Mechanical Properties set forth in the Table. The Mechanical and Physical properties were determined generally in accordance with the procedures of the Appendices.

TABLE C

| | Process Conditions | | | | |
|---|---|---|---|---|---|
| Fiber Lot Number | A | B | C | D | E |
| Ox Ovens (°C.) | | | | | |
| #1 | 230 | 230 | 230 | 230 | 230 |
| #2 | 237 | 237 | 237 | 237 | 237 |
| #3 | 243 | 243 | 243 | 243 | 244 |
| Oxidation Draw (%) | 17 | 17 | 17 | 17 | 17 |
| Low Temp. Furnace (°C.) | | | | | |
| #1 | 420 | 410 | 410 | 415 | 410 |
| #2 | 500 | 490 | 490 | 490 | 495 |
| #3 | 580 | 580 | 580 | 575 | 575 |
| #4 | 690 | 695 | 695 | 690 | 695 |
| #5 | 630 | 625 | 625 | 628 | 630 |
| #6 | 560 | 560 | 560 | 575 | 570 |
| High Temp. Furnace (°C.) | 1305 | 1425 | 1425 | 1425 | 1425 |
| Carb Draw (%) | +2.6 | +2.2 | +2.2 | +3.1 | +2.0 |
| Surf. Treat. (Coulombs/in.) | 0.5 | 2.0 | 0.5 | 0.5 | 0.5 |
| | Physical & Mechanical Properties | | | | |
| Tow Test | A | B | C | D | E |
| Tensile Strength (ksi) | 663 | 602 | 661 | 748 | 738 |
| Tensile Modulus (msi) | 42.8 | 43.2 | 44.9 | 44.1 | 43.3 |
| Strain (%) | 1.60 | 1.44 | 1.52 | 1.74 | 1.72 |
| Wt/UL (lbs/in $\times 10^{-6}$) | 26.0 | 25.6 | 25.8 | 25.4 | 25.4 |
| Density (gm/cm$^3$) | 1.79 | 1.75 | 1.74 | 1.74 | 1.75 |
| Laminate Test | A | B | C | D | E |
| Tensile Strength (ksi) | 676 | 623/633 | 606 | 647/660 | 636 |
| Tensile Modulus (msi) | 39.6 | 39.3/40.0 | 40.6 | 41.9/39.3 | 40.6 |
| Strain (%) | 1.63 | 1.52/1.52 | 1.45 | 1.53/1.59 | 1.50 |
| Short Beam Shear(ksi) | 17.8 | 16.6 | 12.47 | 17.3 | 17.8 |

EXAMPLE 2

Carbon fiber was made using procedures previously described. The polyacrylonitrile starting material was 0.8 denier, made from monomers: acrylonitrile 98%; methacrylic acid 2% and contains a silicone sizing agent. The low temperature furnace had a temperature profile as follows:

| Zones | Average Temperatures (°C.) |
|---|---|
| Zone 1 (entry) | 100 |
| Zone 2 | 330 |
| Zone 3 | 550 |
| Zone 4 | 740 |

The high temperature furnace had a temperature profile based on distance from inlet such as follows:

| Zones | Temperatures (°C.) |
|---|---|
| Zone 1 | 280 |
| Zone 2 | 1000 |
| Zone 3 | 1400 |
| Zone 4 | 900 |

The residence times for the low and high temperature furnaces were between 3 and 4 and 5 minutes, respectively.

The process conditions and results of various runs are set forth in Table D.

TABLE D

| Designation | Fiber Type | Oven 1 Temp. (°C.) | Time (min.) | Stretch (%) | Oven 2 Temp. (°C.) | Time (min.) | Stretch (%) |
|---|---|---|---|---|---|---|---|
| A | 12K | 225.3 | 58.2 | 10.6 | 217.8 | 100.0 | −0.2 |
| B | 12K | 224.5 | 58.2 | 10.4 | 212.6 | 100.0 | −0.1 |
| C | 12K | 220.7 | 37.0 | 21.4 | 231.0 | 79.2 | −0.2 |
| D | 12K | 221.3 | 37.0 | 21.2 | 229.8 | 79.2 | −0.2 |
| E | 12K | 222.2 | 37.0 | 21.3 | 230.2 | 79.2 | −0.2 |
| F | 12K | 221.3 | 37.0 | 21.6 | 230.0 | 79.2 | −0.3 |
| G | 12K | 220.8 | 37.0 | 21.5 | 230.5 | 79.2 | −0.4 |
| H | 12K | 226.7 | 5.3 | 21.4 | 260.1 | 15.8 | −0.2 |
| I | 12K | 226.7 | 5.3 | 21.3 | 261.2 | 15.8 | −0.3 |
| J | 12K | 220.0 | 37.0 | 21.4 | 230.0 | 79.2 | −0.2 |
| K | 12K | 221.6 | 37.0 | 21.6 | 230.3 | 79.2 | −0.3 |
| L | 6K | 236.9 | 37.0 | staged 14.5 | 236.2 | 79.2 | −0.1 |
| M | 6K | 237.6 | 37.0 | staged 14.3 | 235.2 | 79.2 | −0.1 |
| N | 6K | 237.6 | 37.0 | staged 14.5 | 235.6 | 79.2 | −0.1 |
| O | 6K | 235.2 | 58.7 | 10.8 | 235.3 | 58.7 | −0.3 |
| P | 6K | 235.5 | 58.7 | 10.7 | 235.8 | 58.7 | −0.3 |
| Q | 6K | 234.4 | 58.7 | 10.7 | 235.2 | 58.7 | −0.3 |
| R | 6K | 236.2 | 58.7 | 10.7 | 236.7 | 58.7 | −0.2 |
| S | 6K | 227.6 | 37.0 | 10.6 | 227.3 | 79.2 | −0.2 |
| T | 6K | 228.3 | 37.0 | 10.6 | 226.8 | 79.2 | −0.1 |
| U | 12K | 234.4 | 58.1 | 10.6 | 240.7 | 100.0 | +0.2 |
| V | 12K | 234.9 | 58.1 | 10.6 | 240.2 | 100.0 | +0.1 |
| W | 12K | 235.7 | 58.1 | 10.7 | 240.1 | 100.0 | +0.1 |
| X | 12K | 234.3 | 58.1 | 10.7 | 240.6 | 100.0 | +0.1 |
| Y | 12K | 230.8 | 58.1 | 10.6 | 230.7 | 100.0 | −0.1 |
| Z | 12K | 231.6 | 58.1 | 10.5 | 229.7 | 100.0 | −0.1 |
| AA | 12K | 232.0 | 58.1 | 10.6 | 229.5 | 100.0 | −0.1 |
| BB | 12K | 230.5 | 58.1 | 10.6 | 229.5 | 100.0 | −0.2 |
| CC | 12K | 223.0 | 58.1 | 10.6 | 213.3 | 100.0 | −0.2 |
| DD | 12K | 224.1 | 58.1 | 10.3 | 213.8 | 100.0 | −0.2 |

| Carb. | Temp. (°C.) | Stretch (%) | Density (g/cc) | Streng. (Msi) | Modu. (MMsi) | Weight (g/ft) | Cal. Strain (%) |
|---|---|---|---|---|---|---|---|
| A | 1363 | +2.5 | 1.8135 | 734 | 45.1 | 0.1446 | 1.63 |
| B | 1401 | −1.3 | 1.8282 | 723 | 44.9 | 0.1415 | 1.61 |
| C | 1254 | +6.5 | 1.8230 | 681 | 41.7 | 0.1285 | 1.63 |
| D | 1291 | +6.4 | 1.8217 | 731 | 42.7 | 0.1249 | 1.71 |
| E | 1344 | +7.7 | 1.8199 | 730 | 45.3 | 0.1345 | 1.61 |
| F | 1384 | +7.2 | 1.8142 | 729 | 44.4 | 0.1254 | 1.64 |
| G | 1503 | +8.6 | 1.7726 | 637 | 47.2 | 0.1197 | 1.34 |
| H | 1359 | +13.0 | 1.8290 | 817 | 45.1 | 0.1170 | 1.81 |
| I | 1361 | +6.9 | 1.8227 | 789 | 45.6 | 0.1229 | 1.73 |
| J | 1582 | +7.2 | 1.7622 | 736 | 45.2 | 0.1162 | 1.63 |
| K | 1690 | +10.3 | 1.7544 | 755 | 49.1 | 0.1087 | 1.54 |
| L | 1295 | +9.4 | 1.7984 | 655 | 44.5 | 0.0679 | 1.47 |
| M | 1359 | +8.0 | 1.7894 | 659.2 | 44.6 | 0.0696 | 1.48 |
| N | 1398 | +8.4 | 1.7852 | 729.3 | 46.6 | 0.0678 | 1.57 |
| O | 1245 | +9.9 | 1.8023 | 647 | 44.8 | 0.06994 | 1.44 |
| P | 1298 | +9.8 | 1.7961 | 679 | 44.1 | 0.07065 | 1.54 |
| Q | 1354 | +9.8 | 1.7884 | 693 | 45.0 | 0.08111 | 1.54 |
| R | 1408 | +9.1 | 1.7813 | 690 | 47.0 | 0.07033 | 1.47 |
| S | 1347 | +7.3 | 1.8144 | 720 | 42.0 | 0.0671 | 1.71 |
| T | 1393 | +9.7 | 1.8074 | 679 | 42.2 | 0.0658 | 1.61 |
| U | 1262 | +2.7 | 1.7947 | 596 | 44.6 | 0.1542 | 1.39 |
| V | 1313 | +2.2 | 1.7749 | 653 | 42.7 | 0.1545 | 1.53 |
| W | 1365 | +2.3 | 1.7707 | 626 | 44.5 | 0.1517 | 1.40 |
| X | 1403 | +2.7 | 1.7770 | 689 | 44.2 | 0.1514 | 1.56 |
| Y | 1260 | +2.2 | 1.7792 | 618 | 41.3 | 0.1553 | 1.50 |
| Z | 1287 | +1.9 | 1.7940 | 684 | 43.0 | 0.1509 | 1.59 |

TABLE D-continued

| | | | | | | | |
|---|---|---|---|---|---|---|---|
| AA | 1328 | +2.0 | 1.8062 | 676 | 45.3 | 0.1497 | 1.49 |
| BB | 1383 | +1.6 | 1.8358 | 672 | 46.6 | 0.1505 | 1.44 |
| CC | 1258 | +6.7 | 1.8467 | 679 | 45.6 | 0.1302 | 1.49 |
| DD | 1307 | +7.2 | 1.8366 | 704 | 45.6 | 0.1305 | 1.54 |

Appendix A

TEST METHODS (Including Impregnated Strand Test) FOR DETERMINING PHYSICAL PROPERTIES OF CARBON FIBER TOWS 1. Scope. Test methods for determining the density, weight per unit length, ultimate tensile strength (Impregnated Strand Test), Young's modulus of elasticity (Impregnated Strand Test), ionic impurities, and size content of tows of carbon fiber.

2. EQUIPMENT AND DOCUMENTS.

2.1 Drawings

Figure 2:
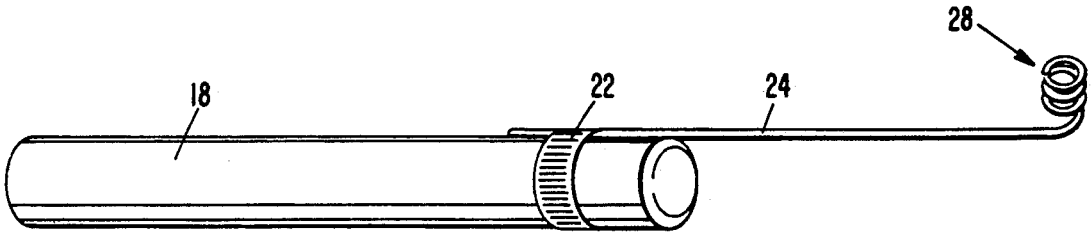

FIG. 1 schematically depicts impregnation of tow 10 of carbon fiber in accordance with the Impregnated Strand Test. Resin solution 12 is in pan 14. Pan 14 is carried on base 16 to which is mounted stand 17. Clamp 20 mounts cross member 18 to stand 17. Clamp 22 mounts wire coil 24 to cross member 18. Clamp assembly 26 carries tow 10 so it can be drawn from resin solution 12 through coil 28 of wire coil 24. FIG. 2 further details cross member 18, wire coil 24 and coil 28. The wire of wire coil 24 is 0.060 inches in diameter. The inner diameter of coil 28 is 0.050 inches.

Figure 3A:
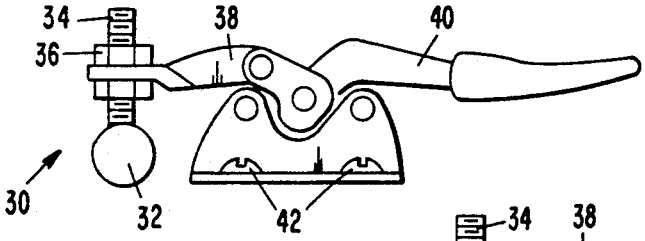
Figure 3B:
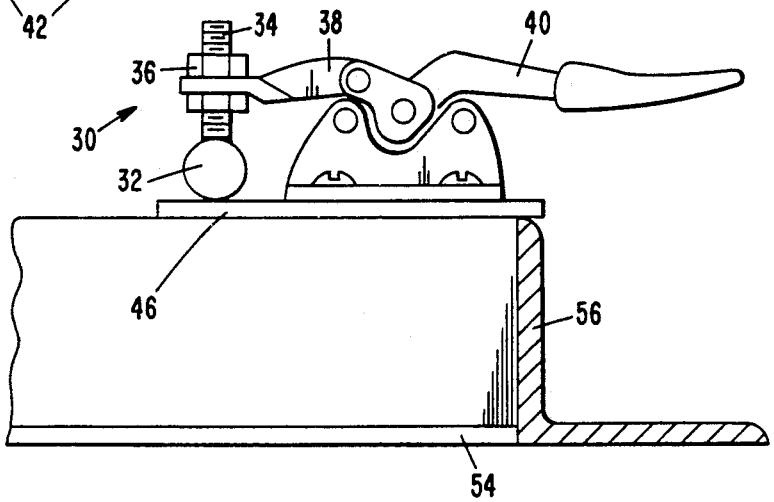
Figure 4A:
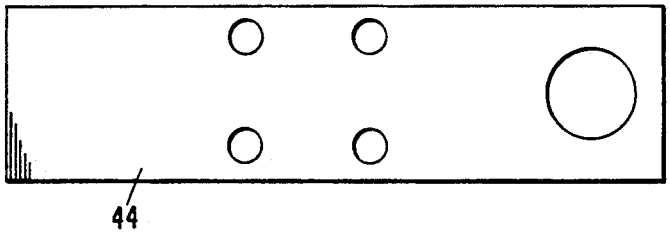
Figure 4B:
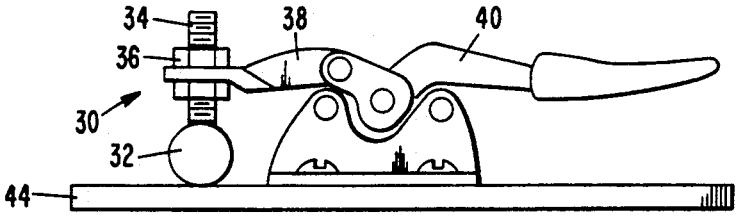
Figure 4C:
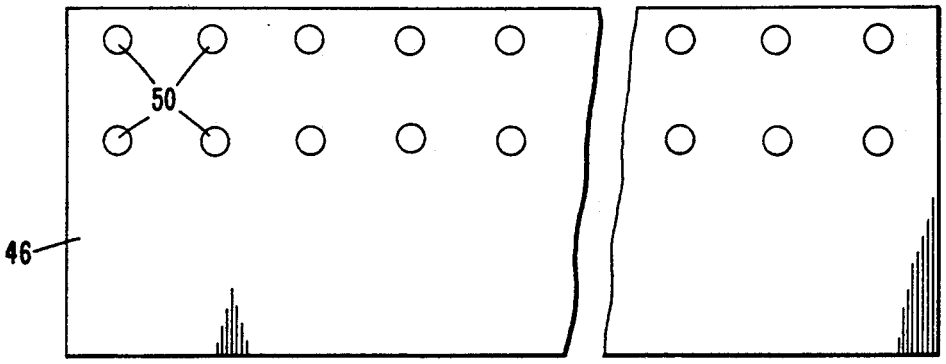
Figure 4D:
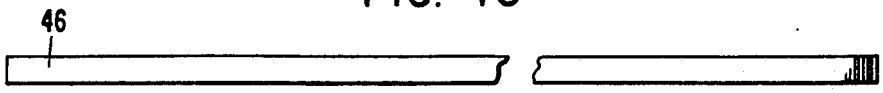
Figure 5A:
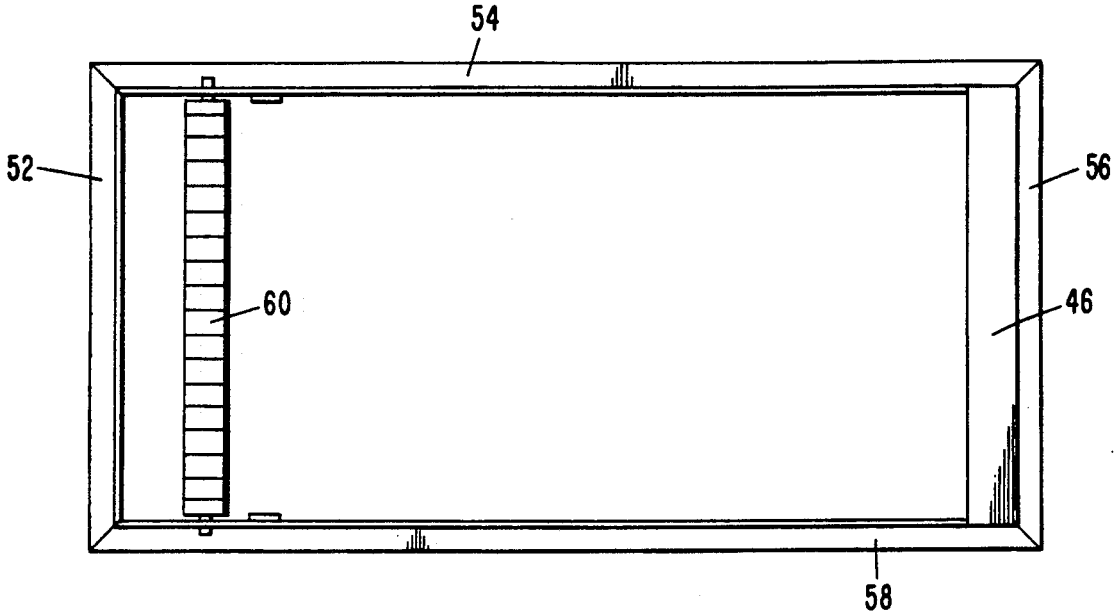
Figure 5B:
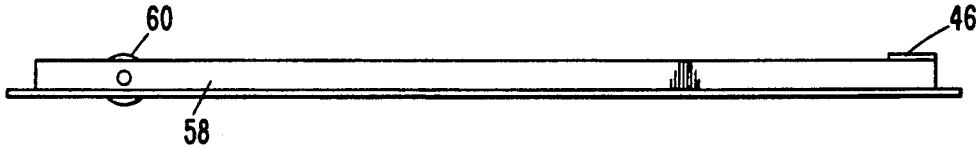
Figure 5C:
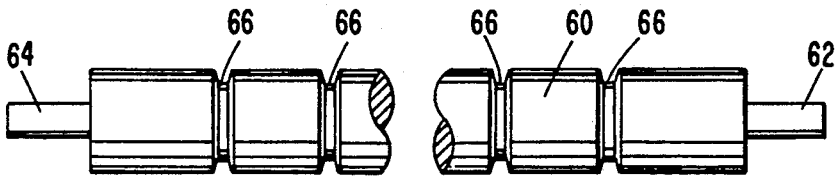
Figure 5D:
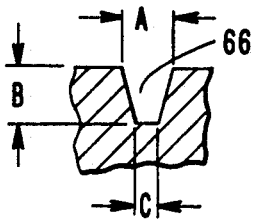

FIGS. 3 (A) and 3 (B), 4 (A) through 4 (D) and 5 (A) through 5 (D) illustrate the specimen curing rack and clamps used therewith for hanging and curing resin impregnated tows of carbon fiber. FIG. 3 (A) shows clamp 30 which corresponds to the clamping device of clamp assembly 26 of FIG. 1. Clamp 30 has adjustable clamp rod 32 which binds the tow of carbon fiber to the base (not shown) on which clamp 30 is mounted. Threaded member 34 is movable through nut 35 mounted on lever arm 38 for adjusting rod 32. Manual activator arm 40 causes lever arm to rotate in clamping the tow of carbon fiber with adjustable clamping arm 38. Bolts 42 bolt clamp 30 to its base.

Clamp 30 can mount to either long base 44 (FIGS. 4 (A) and 4 (B)) or short base plate 46 (FIG. 3 (B)). Short base plate 46 is welded to frame 48 (FIGS. 5 (A) and 5 (B)) of the specimen curing racks through four holes 50 in the short base plate. Base plate 46 can accommodate several clamps for permanent mounting to frame 48.

Frame 48 (FIGS. 3 (B) and 5 (A) and (B)) is made of aluminum and is rectilinear. Frame 48 comprises aluminum angles 52, 54, 56, and 58 which are welded together at their ends.

FIGS. 5 (A) and 5 (B) are respective top and side view of frame 46 of the specimen curing rack. Supports (not shown) mounted on the bottom of frame 46 permit the specimen curing rack to be carried and spaced from a laboratory bench (not shown).

Cylindrical rod 60 is mounted to frame 46 through metal dolls 62, 64. Cylindrical rod 60 is made of aluminum and has grooves 66 (25 in rod 60) which are Teflon® coated. FIG. 5 (D) is a cross section of a groove 66.

The dimensions (a), (b) and (c) in FIG. 5 (D) are 0.10 inch, 0.15 inch and 0.05 inch respectively.

Figures 6A, 6B, 6C, 6D, 6E:
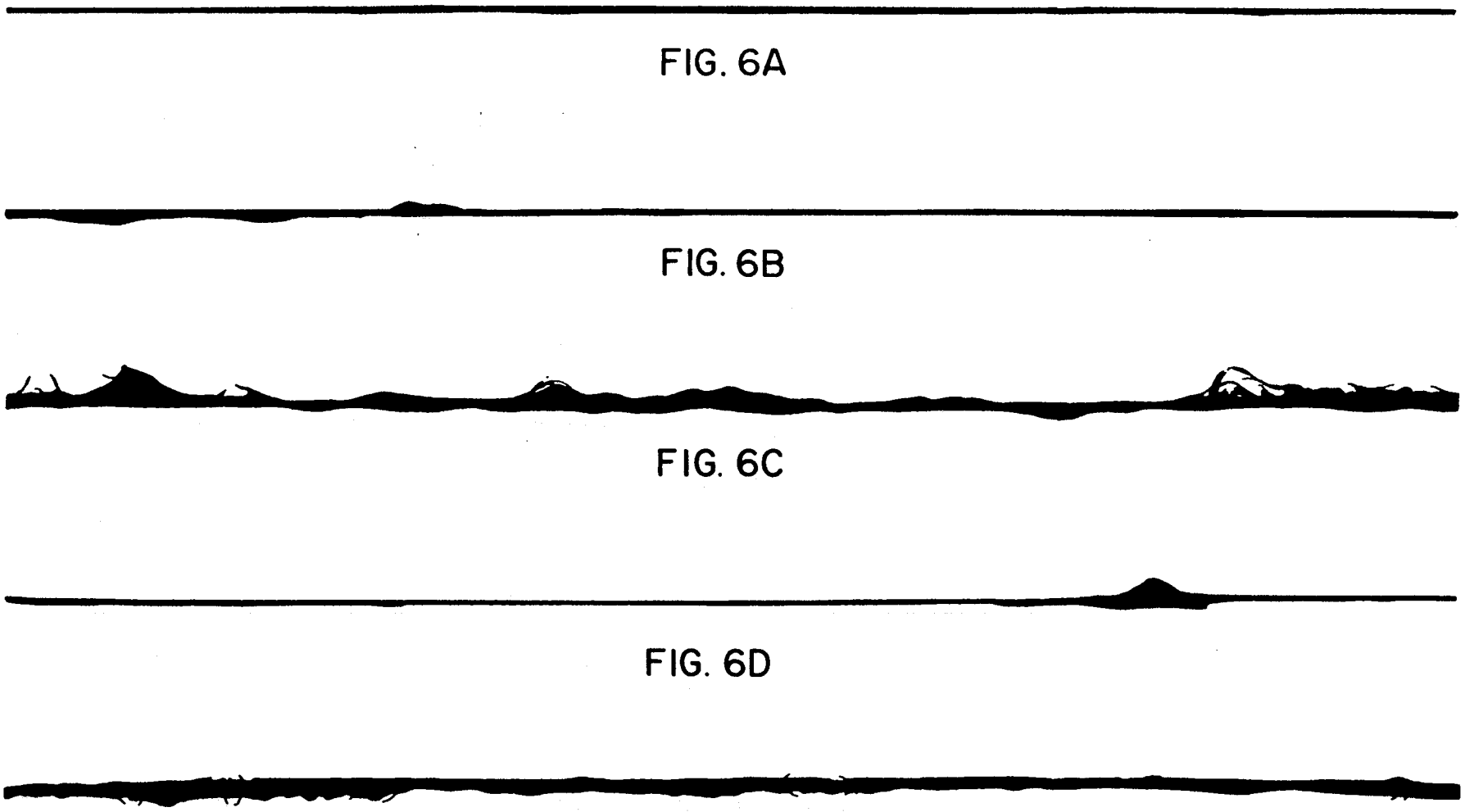

FIG. 6 (A) through (E) illustrate impregnated tows of carbon fiber. FIG. 6 (A) shows a well collimated tow which can be used to finish test. FIG. 6 (B) shows a tow with some catenary which can be cut to permit use of well collimated portion. FIG. 6 (C) shows tow having extreme catenary which is to be discarded entirely. FIG. 6 (D) shows tow having cut filaments in gauge length and is to be discarded entirely. FIG. 6 (E) shows tow having extreme fuzziness to be discarded entirely.

Figure 7A:
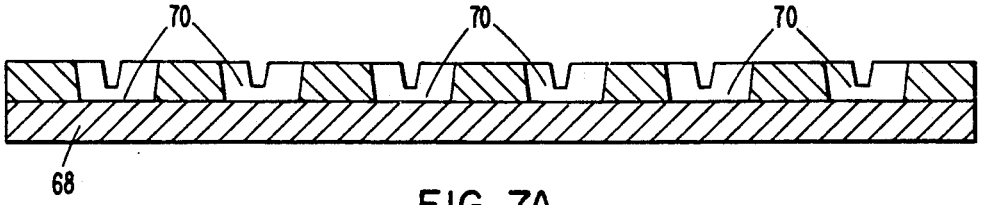
Figure 7B:
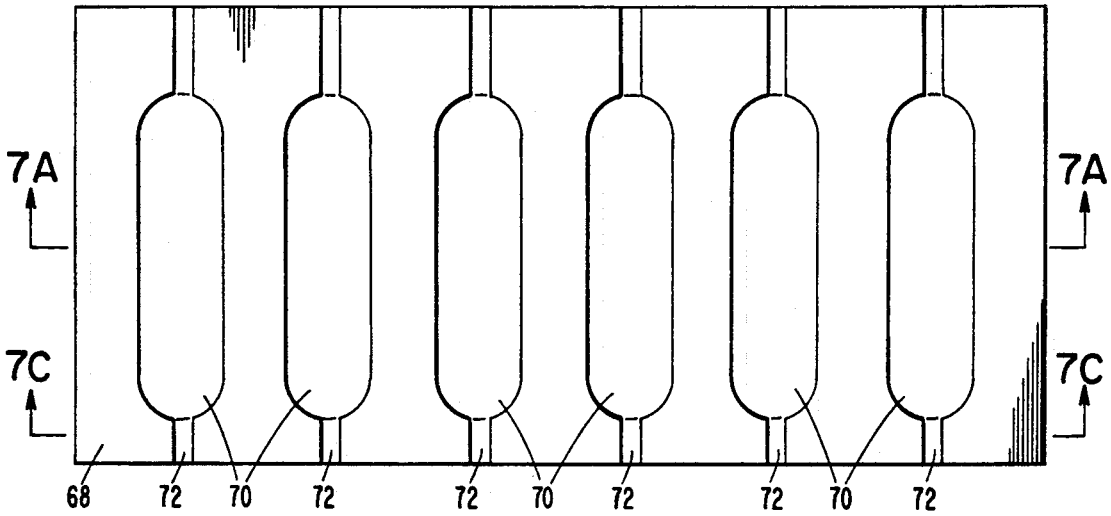
Figure 7C:
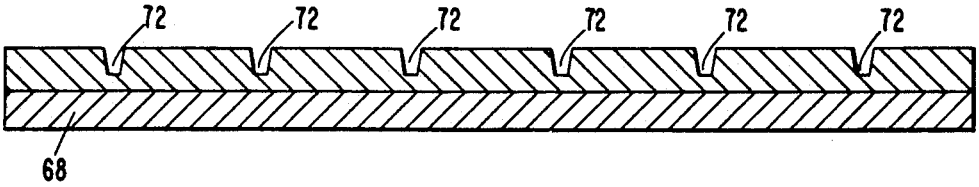
Figure 9A:
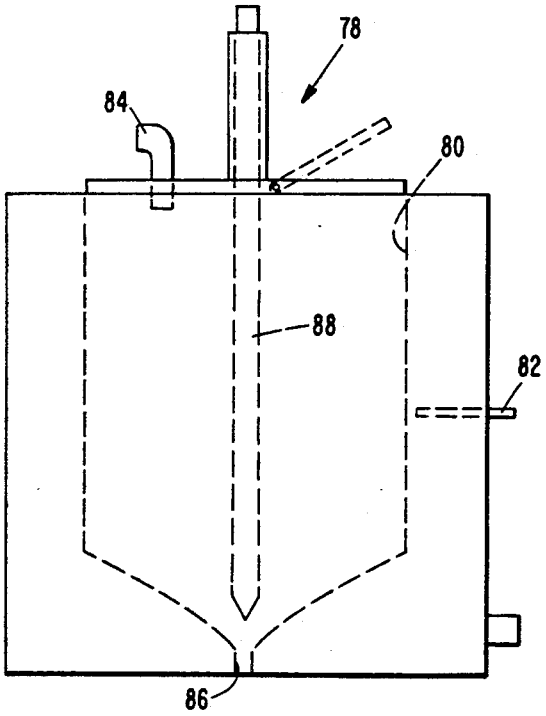
Figure 9B:
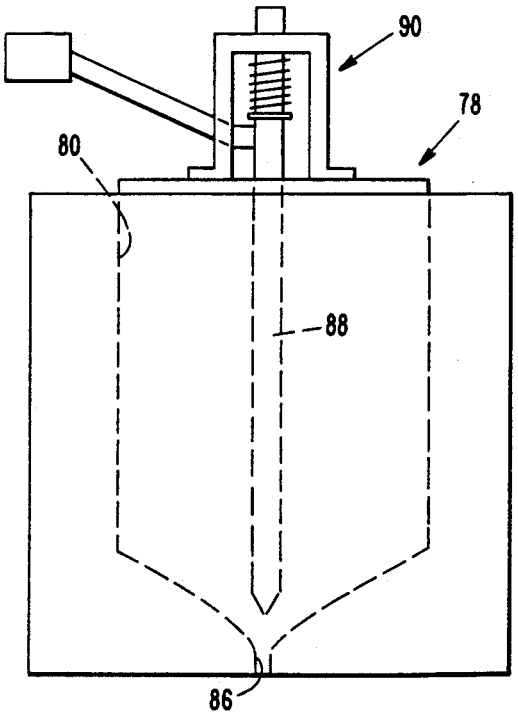

FIG. 7 (A), (B), and (C) show schematically a specimen tab mold 68 in three view, 7 (A) taken at A—A of FIG. 7 (B) and 7 (C) taken at C—C of FIG. 7 (B). Tab mold 68 has tab troughs 70 into which is poured resin from resin dispenser 75 (FIG. 9). Troughs 70 have a 6°±2° angle in their walls shown by x in FIG. 6 (A). Troughs 70 are ⅜±1/64 inch wide at the top and 2.125±0.01 inch long with a radius of 7/32 at grooves 72.

Figure 8A:
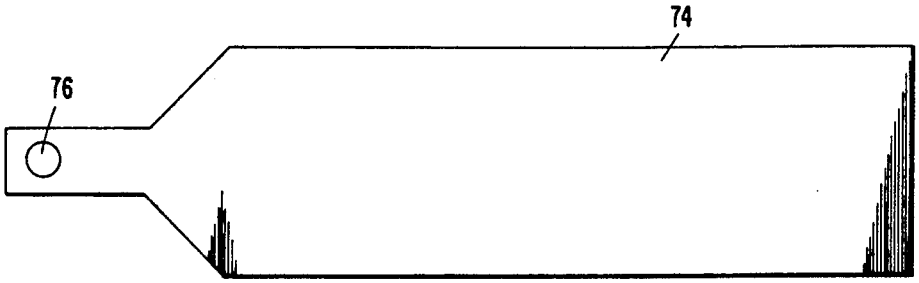
Figure 8B:
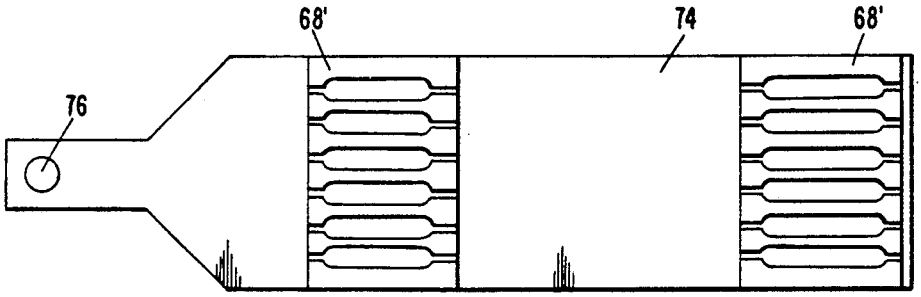
Figure 8C:
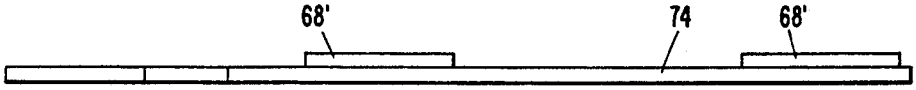

FIGS. 8 (A), (B), and (C) illustrate schematically carrier plate 74 which carried two tab molds 68, 68' as described in connection with FIG. 7. Carrier plate 74 has orifice 76 for mounting plate 74 in the oven. Tab molds 68', 68' are spaced 5.0±0.01 inches apart on carrier plate 74 and permanently affixed thereto.

FIG. 9 shows schematically resin dispenser 75 having heating block 78 in front (A) and side (B) views. Heating block 78 has cavity 80 for carrying molten resin heated by heating coils with heating block 78. Temperature probe 82 is mounted within heating block 78 and sensing temperature for a temperature control unit for heating block 78. The resin in cavity 80 is kept under nitrogen, the inlet therefor being shown as 84.

Resin cavity 80 communicates with ¼" orifice 86 at the bottom of heating block 78 for dispensing resin into cavities 70 (FIGS. 7 and 8) of the tab mold part. Dispenser pin 88 moves in and out of orifice 86 in response to movement of spring loaded filling lever assembly 90.

Figure 10:
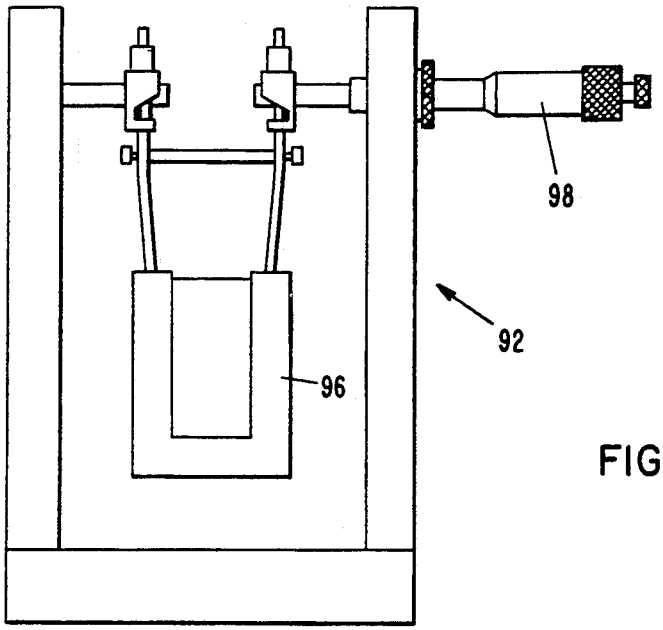
Figure 11:
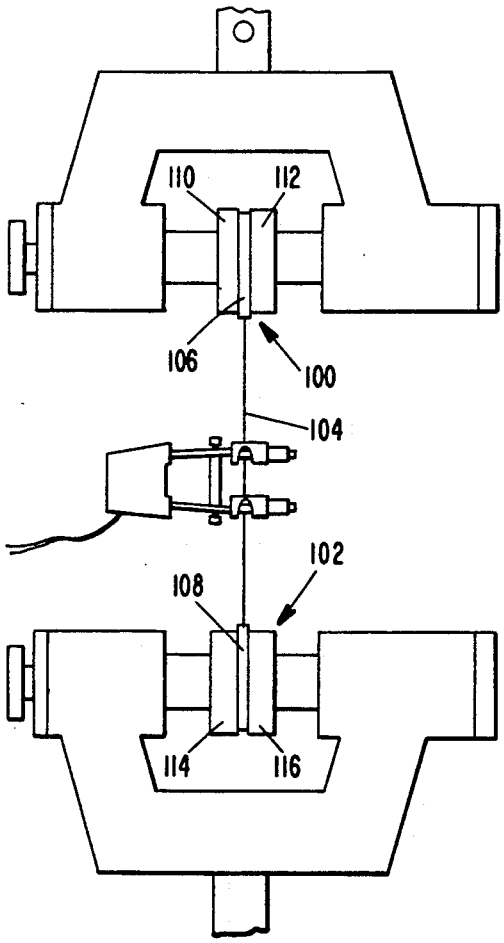

FIG. 10 schematically shows the extensometer calibration fixture 92 comprising stand 94, extensometer 96 and micrometer 98. FIG. 11 shows schematically the grips 100, 102, pneumatically controlled, and tensile specimen 104 having end tabs 106, 108. End tabs 106, 108 fit between grip faces 110, 112, 114, and 116 respectively.

Figure 12:
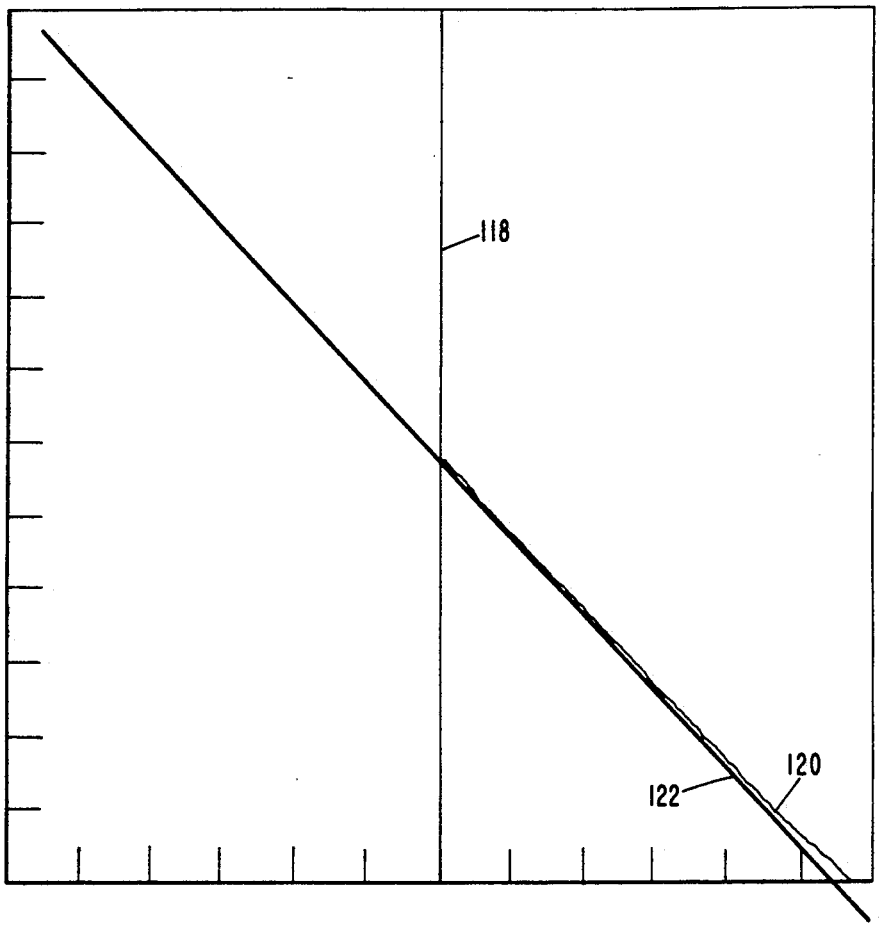

FIG. 12 shows a typical elongation curve having breaking load 118, stress, strain curve 120 and tangent line 122 drawn tangent to curve 120 at point approximately one-half of the breaking load 118.

2.2 American Society for Testing and Materials

| | |
|---|---|
| ASTM D 638-68 | Tensile Properties of Plastics |

3. PROVISIONS 3.1 Equipment calibration. Testing instrumentation and equipment shall be calibrated in accordance with applicable suppliers operating instructions or manuals and requirements of the test facility.

4. MATERIALS AND EQUIPMENT.

| Materials | Description* |
|---|---|
| Tonox 6040 | Amine Blend Naugatuck, Chemical, Uniroyal |
| ERL 2256 Resin | Epoxy Resin Union Carbide |
| DER 330 | Epoxy Resin, Dow Chemical |
| DER 332 | Epoxy Resin, Dow Chemical |
| $BF_3$MEA | Boron Trifloride monoethanol amine, Miller-Stevenson |
| Methanol | ACS Reagent Grade |
| Methylene Chloride | ACS Reagent Grade |
| Resin | Versalon 1200 (General Mills), or equivalent Macromelt 6300 |
| Solvent | Toluene, Reagent Grade |
| Rubber | .85 ± .20 × .85 ± 20 × .03 ± .01 |
| Nitrogen | |
| KCL Standard | 0.01N, Type SS-1, Beckman Instrument Co., or equivalent |
| Methyl ethyl ketone (MEK) | ACS Reagent Grade |
| Release agent | Carr #2, or equivalent |

| Equipment | Description* |
|---|---|
| Toggle clamps | FIG. 3, 4 |
| Rack, specimen curing | FIG. 5 |
| Heating block, resin | FIG. 9 |
| Melting pot, resin | FIG. 9 |
| Grips, specimen | FIG. 11 |
| Specimen mold | FIG. 7, 8 |
| Specimen-preparation equipment | FIG. 1, 2 |
| Pycnometer | Hubbard Type, or equivalent |
| Forced air oven | Blue M Power-O-Matic 60 (Blue M Electric Co.) Blue Island Illinois, equivalent |
| Extensometer | Instron Catalog Number (no.) G-51-11 |
| Balance | Analytical balance, Mettler B-5, or equivalent |
| Vacuum desiccator | Pyrex, A. H. Thomas catalog no. 4443, or equivalent |
| Vacuum source | Water aspirator or air pump, A. H. Thomas catalog no. 1038-B, or equivalent |
| Centrifuge | International Clinic Centrifuge Model CL, or equivalent |
| Constant temperature bath | Capable of maintaining 25° C. ± 0.1° C. (± 0.2° F.) |
| Thermometer | Graduated in 0.1° C. subdivisions |
| Tensile tester | Instron, floor model, Model FM, or bench model |
| Wire coil | FIG. 2 |
| Conductivity meter | |
| Conductivity cell | 0.1 cell constant |
| Extraction flask | 500 ml, ground joint |
| pH meter | |
| Oven | Capable of maintaining 163° ± 3° C. |

NOTE:
Equipment shown on applicable drawings is also required.
*(Unless otherwise indicated, source is commercial.)

5. TEST PROCEDURES 5.1 Determination of tow density. The tow density shall be determined in accordance with the following:

5.1.1. Calibration of pycnometer. The pycnometer shall be calibrated as follows:

a. Clean the pycnometer thoroughly using sodium dichromate cleaning solution.

b. Dry the interior by rinsing it successively with tap water, distilled water, and either alcohol and ether or acetone.

c. Expel the solvent vapors with a current of air which has been passed through absorbent cotton and Drierite. Do not subject pycnometer to any considerable elevation of temperature.

d. Prior to weighing, wipe the entire pycnometer first with a pipe of clean moist cloth and then with a dry cloth. Weigh the empty pycnometer immediately.

e. Carefully fill the pycnometer with freshly boiled distilled water which is slightly below the temperature of the bath.

f. Insert the pycnometer plug with a rotary motion to avoid the inclusion of air bubbles and then twist until it seats firmly but not so tight that it locks.

g. Place the pycnometer in a constant temperature bath maintained at 25°±0.1° C. Leave the pycnometer in the bath at least 30 minutes.

h. Check the bath to be certain the temperature has not changed. Then remove the pycnometer from the bath and wipe the excess water from the top of the plug using one stroke of the hand or finger.

i. Wipe the surface of the pycnometer with absorbent material giving special attention to the joint where the plug enters the pycnometer.

j. At this point, examine the pycnometer to be certain that it is entirely filled with water. (If any air bubbles are present, fill the pycnometer again and replace it in the bath.)

k. Remove the pycnometer from the bath and wipe the entire surface with a piece of clean moist cloth and then with a dry cloth. Special attention should be given to the area around the joint where the plug enters the pycnometer. Weigh the pycnometer immediately.

5.1.2 Density determination. The density of the tow shall be determined as follows:

NOTE: Sizing must be removed from sized tow prior to the density determination.

a. Accurately weigh enough of the sample into the pycnometer to fill the pycnometer approximately one-third full (approximately 2 gram sample).

b. Carefully fill the pycnometer with boiled, distilled water. Place the pycnometer in a beaker within a vacuum desiccator. Evacuate until the water boils. Release the vacuum and again evacuate until bubbles appear, then seal the desiccator and leave the samples under vacuum for 5 minutes.

c. Remove the pycnometer from the desiccator. If necessary, add more boiled, distilled water and centrifuge the pycnometer for 5 to 10 minutes.

d. Insert the pycnometer plug such as to avoid the inclusion of air bubbles, then twist until the plug seats firmly but not so tight that it locks.

e. Place the pycnometer in a beaker filled with boiled, distilled water such that the pycnometer is submerged.

f. Place the beaker containing the pycnometer in a constant temperature bath maintained at 25° C.±0.1° C. Keep the beaker covered with a watch glass.

g. Leave the pycnometer in the bath at least 30 minutes. After 30 minutes, the pycnometer may be removed from the bath for weighing if the temperature has not changed for 10 minutes or if the fluctuation has been less than 0.1° C. (0.2° F.).

h. Remove the pycnometer from the bath and wipe the excess water from the top of the plug using one stroke of the hand or finger. Wipe the surface of the pycnometer with absorbent material with special attention given to the joint where the plug enters the pycnometer. Weigh the pycnometer immediately.

NOTE: If after removal of the pycnometer from the bath and wiping the plug, warming of the pycnometer causes the water to bead on the plug, do not remove the bead of water, but rather weigh the pycnometer as soon as possible.

i. Calculation:

Tow Density (lb/in.$^3$) at $$T\,^\circ\text{C.} = \frac{A \times E}{A + B - D} \times 0.0361$$

Where:

A = weight of sample, g.

B = weight of pycnometer plus water, g.

D = weight of pycnometer plus water plus sample, g.

T = temperature of bath. Unless otherwise stated, maintain bath at 25° C.±0.1° C.

E = density of water at temperature T° C. Unless otherwise stated, T° C. shall be 25° C. and the density (E) is 0.9971 g/ml.

5.2 Weight per unit length determination.

Determination of the weight per unit length of the tow shall be in accordance with the following:

a. Remove and discard a minimum of one complete layer of fiber from the spool. Then select a test length of fiber by pulling the tow off the spool in such a manner so as to prevent any side slippage of the tow as it is pulled off the spool. Smooth and collimate fiber specimen with gentle action of the fingers.

b. Cut tows into 48 inch (nominal) lengths. A minimum of 1 specimen is required.

c. Measure the actual length of each piece of tow to the nearest 1/32 inch.

d. Weigh each piece of tow to the nearest 0.1 milligram.

e. Calculation: Weight per unit length (pounds/inch)

$$W_f = \frac{Wd(0.0022)}{B}$$

or for sized tow $$W_f = \frac{Ws(0.0022)}{B} \quad \frac{100 - \%\ \text{size}}{100}$$

Where:

Wd = weight of each specimen of dry tow, g.

Ws = weight of each specimen of sized tow, g.

B = length of each specimen, inches.

% size = wt. percent size from 5.6 f. Record the weight per unit length of each tow specimen.

5.3 Determination of ultimate tensile strength and Young's Modulus of elasticity using Impregnated Strand Test.

The ultimate tensile strength and Young's modulus of elasticity of the tow shall be determined in accordance with the following:

5.3.1 Tow impregnation. Tow impregnation shall be in accordance with the following:

a. Prepare the impregnating resin solution I. as shown in Table I. Mix well. Do not heat.

SAFETY NOTE: Wear gloves when handling resins or any resin related product when exposed for greater than 5 minutes accumulative time in any hour period.

TABLE I

| Impregnating resin solution | |
|---|---|
| Ingredient | Parts by weight |
| Resin, ERL 2256 | 300 |
| Tonox 6040 | 88.5 ± 1.5 |
| Toluene | 66.6 ± 2.0 |

As alternatives to the above resin solution, the following can be used:

II. Mix 150, grams methylene chloride with 250 grams DER 332 resin to form component A;

Mix 54.6 grams Tonox 60/40 with 345.4 grams methylene chloride to form component B; and Mix A and B for impregnating solution; or III. Mix 600 grams DER 330 with 246 grams methylene chloride to form component A; Mix 18 grams $BF_3$MEA with 30 grams methyl ethyl ketone (MEK) to form component B; and Mix A and B for impregnating solution.

b. Transfer the resin solution into a pan as shown in FIG. 1. The resin solution shall be used within one hour after preparation.

c. Cut tow specimens to length (49.0±2.0 inches long). Attach a clamp (See FIG. 1) to one end. Coil the tow in the pan of resin solution to within 1.5±0.5 inches from the clamp. Raise the claim until the start of the impregnated section of the tow is next to the coil. (See FIG. 1) Wind that area of the tow into the coil.

NOTE: Choose a (orifice) wire coil size from which to obtain the proper resin content of 40 to 60 percent with carbon fiber. The wire coil orientation should be approximately vertical. To use the orifice correctly, draw the impregnated tow through the coil parallel to the cylinder formed by the wire coil.

d. Remove and collimate the resin-wet tow by pulling it slowly (approximately 1 foot/second) through the wire coil.

e. Hang impregnated tow horizontally on a specimen rack (See FIG. 5). Lay the clamp which has been attached to the tow (See FIG. 4) over the grooved roller (See FIG. 5(*c*)) and fix the loose or other end in the clamp, which is attached to the rack.

f. Examine strands for filament collimation in accordance with FIG. 6. Discard and remake all strands which are not acceptable.

g. Cure samples in a pre-heated oven at 350°±10° F. (177°±5° C.) for a minimum of one hour if resin I is used. If resin II is used, cure at 130° C. for 45 minutes followed by 175° C. for four hours. If resin II is used, cure at 85° C. for 45 minutes followed by 175° C. for four hours.

h. Repeat c. through g. for each tow specimen (5.2). Impregnate enough tows to satisfy 5.3.6-b. A maximum of two tows per spool should be sufficient.

5.3.2 Resin content determination. The resin content of the cured impregnated tows shall be determined in accordance with the following:

a. Cut each impregnated tow into three equal lengths (for 13 inch samples) or, four equal lengths (for 10 inch samples). Accurately measure lengths of each piece to the nearest 1/32 inch and weigh each piece to the nearest 0.1 mg. Calculate and record the weight per unit length of each impregnated tow in lb/in.

b. Calculation: Resin content (weight percent) =

$$\frac{Wi - Wf}{Wi \times 100} = \% R$$

Where:

Wi=weight per unit length of impregnated tow, lb/inch.

Wf=weight per unit length of dry tow (from 5.2), lb/inch.

c. Report the resin content of each 48 inch length of impregnated tow. Discard sample if resin content is less than 40 weight percent or greater than 60 weight percent.

5.3.3 Attachment of end-piece tabs. End-piece tabs shall be in accordance with the following:

a. Place the cut lengths (10" or 13") (5.3.2-a) of impregnated tows in the specimen mold (FIG. 7). This allows a span of 5.0±1/16" long between the end tabs. The end tab or grip piece will be about ¼"×⅜"×2.0", and molded on each end of the cut lengths.

NOTE: Mold cavities must be coated with a release agent such as Care #2 or equivalent.

b. Run Macromelt 6300 (or equivalent) Polyamide resin into the mold cavities from nitrogen blanketed reservoir (FIG. 9), containing molten resin maintained at 300°±5° C. (600°±10° F.).

5.3.4 Calibration of extensometer and load. Calibrate the extensometer (10% maximum strain capability) and load as follows:

a. Set the extensometer on the special calibration fixture (FIG. 10). Adjust the micrometer to give a gap separation of exactly one inch. Adjust the strain recorder to give zero reading on the chart.

b. Open the extensometer 0.020 inches by rotating the micrometer. Adjust the strain recorder to register the proper chart travel depending on scale used. Use actual scale that will be used for testing samples (scale 500/1 is preferred). Do not let the extensometer swing or rotate on the fixture when turning the micrometer.

c. Repeat until zero, 0.005, 0.010, and 0.020 inch recordings register without adjusting.

d. Calibration of the extensometer should be done before testing begins, after a maximum of 48 specimens have been tested, or when Instron operators change.

e. Calibration of load shall be by dead weight at the beginning of testing. Use a 10 pound weight on a 20 pound full scale load. Load calibration must be done after 48 specimens have been tested or when operators change. Shunt calibration may be substituted for dead weight for subsequent calibrations.

5.3.5 Test procedure. The following should be used.

a. Mount the specimen in the pneumatic grips of the Instron tensile tester (FIG. 11). The end tabs should be aligned in the grips parallel to the side of the grips and perpendicular to the crosshead.

b. Apply light tension (up to 48 pounds) to the specimen gently by extending the crosshead.

c. Attach a one inch gage length strain gage extensometer (Instron catalog No. G-51-11) with 10 percent maximum strain capability to the impregnated tow (FIG. 10).

d. Use a 0.5 inch per minute crosshead speed.

e. Select a load scale 200 or 500 lbs. which best measures the type of fiber being tested.

f. Load the specimen to failure while simultaneously plotting the load versus elongation as shown in FIG. 12.

g. Discard all results from any specimen in which failure occurs in an inordinate manner, i.e., jaw breaks, slipped end tabs, sample breaks while removing extensometer, etc. A minimum of four good tests are required for calculations.

NOTE: Jaw breaks are defined as a single break at one tab end with the full length of the impregnated tow strained remaining intact on the opposite tab.

5.3.6 Ultimate tensile strength. The ultimate tensile strength of the tow shall be calculated as follows:

a. Calculation: Tow tensile strength (uncorrected for resin load) (psi)=

$$S_T = \frac{P_{max}}{(Wf/pf)} = \frac{P_{max}}{Af}$$

Where:

$P_{max}$=ultimate breaking load of impregnated tow, pounds

Af=cross sectional area of tow (WF/pf), square inch

Wf=weight/unit length dry tow (5.2), pounds/inch pf=density of tow (5.1), pounds/cubic inch NOTE: Calculations may be corrected to account for the load carried by the resin as described in the addendum.

b. Report the median of a minimum of four determinations.

5.3.7 Young's modulus of elasticity. The Young's modulus of elasticity of the tow shall be determined in accordance with the following:

a. Using the load elongation chart produced by the Instron Tensile Tester (5.3.5) determine the following parameters:

L=incremental strain determined by inspection, inches.

P=load increment at the selected incremental strain, pounds b. Calculation: Young's modulus of elasticity (uncorrected for resin load) (psi)=

$$E_T = \frac{\Delta P}{Af} \times \frac{L}{\Delta L}$$

Where:

Af=cross sectional area of tow (5.3.6) square inches.

L=gage length over which strain is measured (1 inch)

c. By arranging ΔL to be 0.01 inch by setting the chart magnification ration to 500/1 and taking P at a chart distance of five inches, the calculation can be simplified to:

$$E_T = \frac{\Delta P}{Af} \times \frac{1}{0.01} = \frac{\Delta P}{Af} \times 100$$

The value of ΔP can be determined by drawing a modulus slope from the load-elongation curve by extending a line tangent to the linear portion of the curve at a point approximately one-half the obtained breaking load (See FIG. 12).

NOTE: Calculations may be corrected to account for the load carried by the resin as described in the addendum.

d. Report the average of a minimum of four determinations.

5.4 Ionic impurities determination (conductivity).

Ionic impurities of surface treated carbon or graphite fibers are determined by measuring the conductivity of water extracts in accordance with the following:

5.4.1 Preparation of conductivity water.

a. Run distilled water through a demineralizer.

b. Determine the conductance of the water at 20°±0.5° C. Continue to take the readings until a constant reading is obtained.

c. The conductance is measured by dipping the cell in the solution and balancing the meter. Make sure no bubbles adhere to the electrodes.

d. The conductance of the water should be less than 10 umho/cm.

5.4.2 Calibration of cell constant.

a. Condition of KCl standard to 20°±5° C.

b. Determine the conductance as described in 5.4.1.

c. Calculate the cell constant as follows:

$$K = \frac{\text{cell constant for 0.1N KCl std.}}{\text{Observed Reading}}$$

5.4.3 Conductance of water samples.

a. Condition the water to 20° C.±0.5° C.

b. Measure the conductance as described in 5.4.1.

c. Calculate as follows: Conductance (umho/cm)=K33 observed reading 5.4.4 Graphite or carbon fiber samples.

a. Weigh 10 grams of sample into a 500 ml extraction flask.

NOTE: If sufficient fiber is not available for a 10 gram sample, use a ratio of 10 grams/200 ml of water.

b. Add 200 ml of conductivity water.

c. Connect to a reflux condenser and bring rapidly to a boil.

d. Disconnect and remove the flask while the solution is still boiling. Close immediately with a glass stopper preferably fitted with a stopcock.

f. Cool rapidly to 20°±0.5° C. Filter sample through sharkskin filter paper.

g. Transfer some of the extract to a beaker and determine the conductance of the solution as in 5.4.1. Calculate the conductance as in 5.4.3.

h. Run a blank solution along with the fiber samples and subtract the blank conductance from the sample conductance.

i. Report the conductance of the sample extract and the temperature of determination.

5.4.5 pH of extract. If requested, use the remaining sample extract not used for conductivity to determine the pH with a pH meter. Report the pH for each conductivity test.

5.5 Sizing content. The sizing content of the fiber shall be determined as follows:

a. Weigh 2 to 3 grams (f) of fiber to nearest 0.1 milligram (mg).

b. Place specimen in 250-milliliter (ml) Erlenmeyer flask, and add 100 to 125 ml of methylene chloride.

c. Place rubber stopper on flask, and shake flask gently for approximately 1 minute.

d. Decant methylene chloride, being careful not to lose any fiber.

e. Repeat steps b, c, and d two additional times.

f. Remove specimen from flask.

g. Place specimen in oven for minimum of 5 minutes at 177±5 degrees Celsius (°C.).

h. Remove specimen from oven, cool to room temperature, and weigh to nearest 0.1 mg.

i. Calculate sizing content as follows:

$$\text{Percent sizing} = \frac{W_1 - W_2}{W_1}(100)$$

Where:

$W_1$=original weight of sample, g.

$W_2$=weight of sample after removal of sizing, g.

Addendum to Tow Test

CORRECTION OF CALCULATIONS

SCOPE. The tensile strength and elastic modulus calculations (5.3.6 and 5.3.7) assume that all of the load on the test specimen is carried by the carbon or graphite fiber. While the values calculated using this assumption closely approximate the properties of the tow, an even closer approximation may be made by correcting the breaking load and the incremental load used in the elastic modulus calculation to account for the load carried by the resin. Typical correction methods are as follows:

A.1 Tensile strength correction. Fiber tensile strength corrections for resin contribution are complicated by the fact that the impregnating resin does not show a constant stress/strain relationship as does the fiber. There is no "typical" modulus for the resin because the stress/strain relationship is curved rather than linear. The curvature of the stress/strain curve also varies from lot to lot, can to can, and even mix to mix. Ideally, then one should know the stress/strain curve for the particular mix used to impregnate the test specimens, but this is not economically feasible. What has been determined to be reasonable practice is to use the average secant modulus of the resin at the average breaking strain for the particular fiber being tested. The tensile strength correction is, therefore, calculated as follows:

a. Average secant modulus values ($E_r$) for ERL 2256/Tonox are as shown in Table II.

TABLE II

| Secant Modulus for ERL 2256/Tonox | |
|---|---|
| Fiber | $E_r$, $10^3$ psi |
| Type A | 458 |

b. Calculate average cross-sectional area of resin ($A_r$) in the impregnated tow:

$$A_r = \frac{(W_1 - W_f)}{pr}$$

Where:

$W_i$=weight per unit length of impregnated fiber, lbs/inch $W_f$=weight per unit length of dry fiber, lbs/inch Pr=resin density (0.0455 for ERL 2256/Tonox), lbs/inch$^3$ lbs/inch$^3$ c. Calculate the load carried by the resin (Pr) at breakage:

$$Pr = \frac{P_{max}(0.01\,E_r)(A_r)}{Py}$$

Where:

$P_{max}$=breaking load, lbs.

Py=total specimen load at 1% strain, lbs.

$E_r$=resin secant modulus (Table II), psi d. Calculate the corrected tensile strength, ($S_c$) of the fiber:

$$S_c = \frac{(P_{max} - P_r)}{A_f}$$

Where: $A_f$=cross-sectional area of fiber (5.3.6), square inch.

A.2 Modulus of elasticity correction. The modulus of elasticity correction for the resin contribution is also calculated using the average secant modulus of the resin at the average strain for the particular fiber being tested as discussed in A.1. The calculation is made as follows:

a. Calculate the resin load at 1% strain ($P_{rl}$):
$P_{rl}=(0.01\ E_r)\ (A_r)$ b. Calculate the corrected modulus of elasticity ($E_e$) of the fiber as follows:

$$E_e = \frac{(P_y - P_{rl})}{A_f/0.01}$$

Appendix B

TEST METHODS FOR DETERMINING PROPERTIES OF CARBON FIBER TOWS USING THE LAMINATE TEST

1. SCOPE

Methods for determining the density, length per unit weight, ultimate tensile strength (Laminate Test), percent elongation at failure, Young's modulus of elasticity (Laminate Test), twist and size content of graphite tows and short beam shear strength (Laminate Test).

2. DEFINITIONS

2.1 Lot

A lot shall consist of carbon fiber produced from one continuous production operation under one set of operating conditions. This lot may be produced with interruptions in processing of up to 72 hours assuming all fiber is produced under the same process conditions and is processed at steady state conditions.

2.2 Sampling

Randomly select a minimum of six spools of fiber from each doff or two spools for every 8-hour production shift for testing to yield lot averages for fiber density, weight per unit length, sizing level, and workmanship. Randomly select one sample per lot for twist testing. Enough samples will be selected from the first and last doffs to allow a set of laminates to be made. If the fiber run exceeds six days, laminate tests shall be performed on a midrun doff.

3. PROVISIONS

3.1 Equipment Calibration

Testing instrumentation and equipment shall be calibrated in accordance with applicable suppliers operating instructions or manuals and requirements of the test facility.

3.2 Drawings

Figure 13:
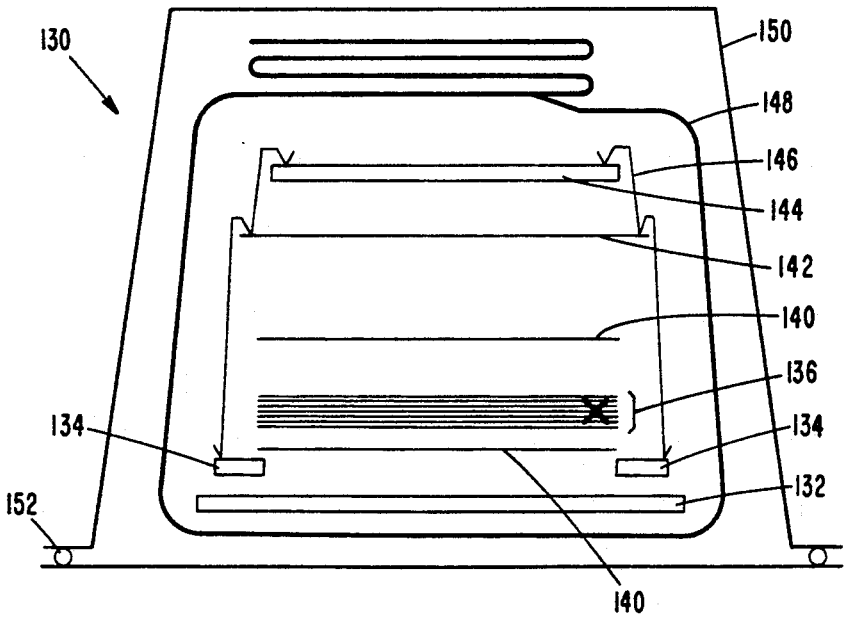

FIGS. 13–18 illustrate procedures and equipment used in the Laminate Test for determining Tensile Strength, Modulus and Short Beam Shear Strength. In FIG. 13 is shown lay up device 130 for laying up specimens for the Tensile and Modulus tests. In FIG. 13 is depicted aluminum base plate 132 which has a thin uniform coat of Frekote 33 release agent, cork dam 134 which has a pressure sensitive Corprene adhesive backing, prepreg panel 136 with thermocouple 138, peel plies (top and bottom) 140, Teflon release film 142, Caul plate 144, pressure sensitive green polyester silicone tape 146, air bleeder 148 of four plies of Style 1581 fiberglass, vacuum bag 150 of Film Capron 80, nylon (0.002 inches thick and high) temperature sealant 152. For tensile specimens the prepreg lay up is nominally 0.040 inches thick while shear specimens are nominally 0.080 inches thick. Further, the release fabric 140 is Engab TX 10-40 release (porous) fabric in making the shear specimens.

Figure 14:
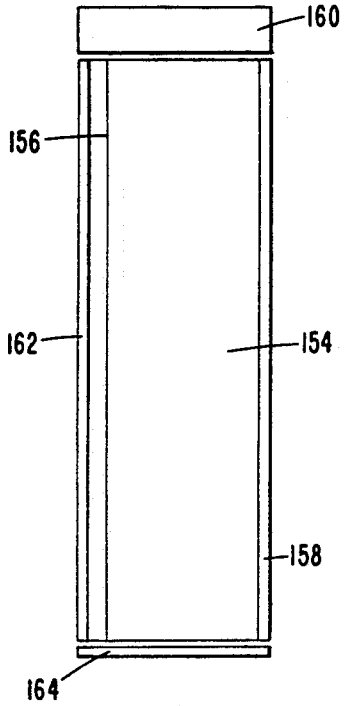

FIG. 14 schematically depicts trimming of the Tensile Panel 154 where 156 is the Kevlar tracer yarn. During trimming, borders 158, 160, 162 and 164 are removed from around specimen 154 where 158, 162, and 164 are ¼ inch wide and 160 is ¾ inches wide.

Figure 15A:
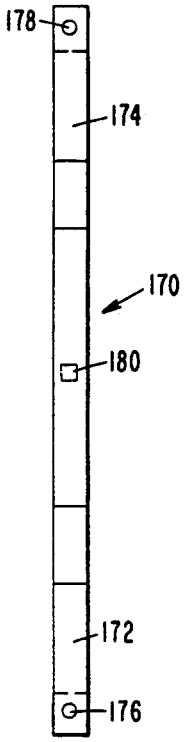
Figure 15B:
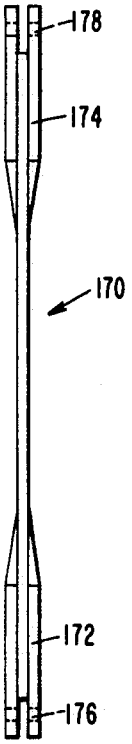

FIG. 15 (A) and (B) illustrate tensile specimen 170 having end tabs 172, 174 adhered to each end. End tabs 172, 174 have orifices 176, 178 and extend beyond the ends of tensile specimen 170. Tensile specimen 170 is of 0.040 nominal thickness, 9 inches long (0° fiber direction) and 0.50 inches wide. Tensile specimen 170 is shown in FIG. 15 (A) with strain gauge 180.

Figure 16:
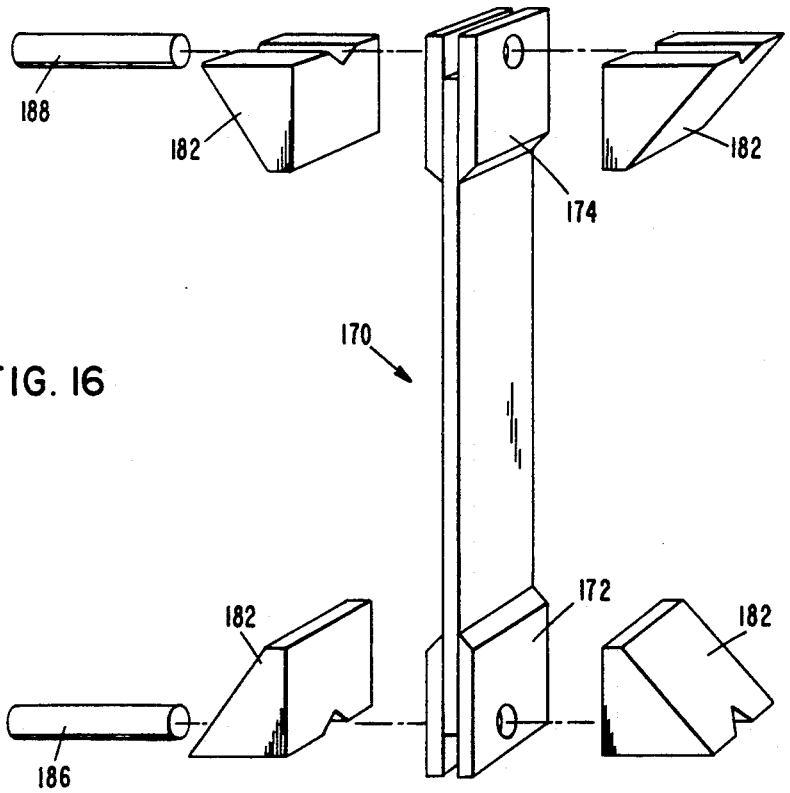
Figure 16A:
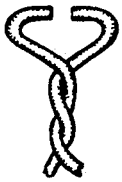

FIG. 16 shows schematically the 0° test arrangement in which modified Instron grips 182, 184 along with rods 186, 188 are shown aligned with their positions on end tabs 172, 174 during testing. FIG. 16A illustrates the shape of the wire of 5.5.4.1.9(b).

Figure 17:
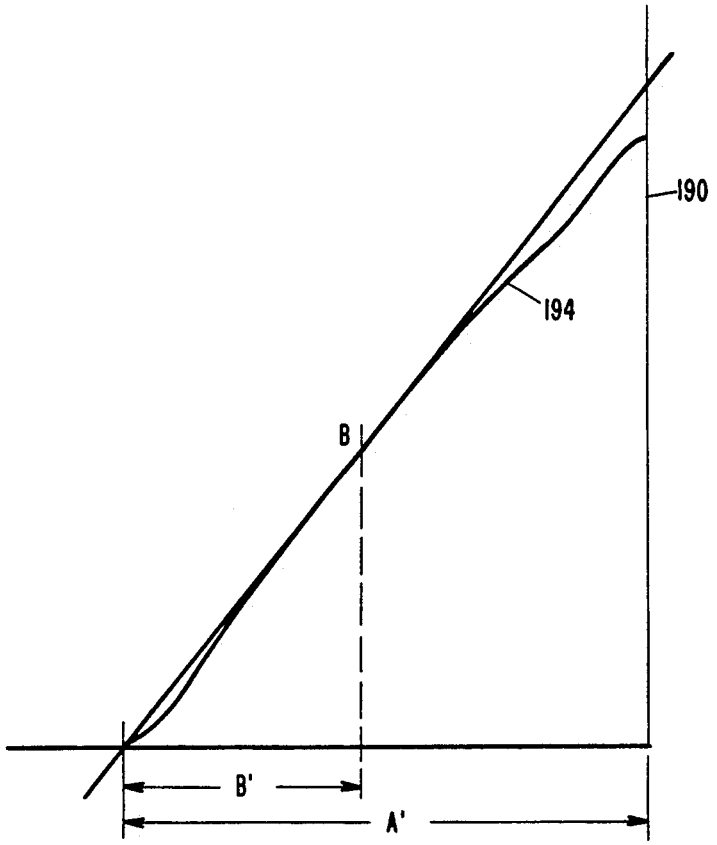

FIG. 17 shows a stress strain curve wherein 190 is the maximum load, 192 is one-half the maximum load, 194 the empirical stress strain curve and 194 is the line drawn tangent to the curve 194 at one-half maximum load. The slope of curve 194 is the tensile modulus of the Laminate Test.

Figure 18A:
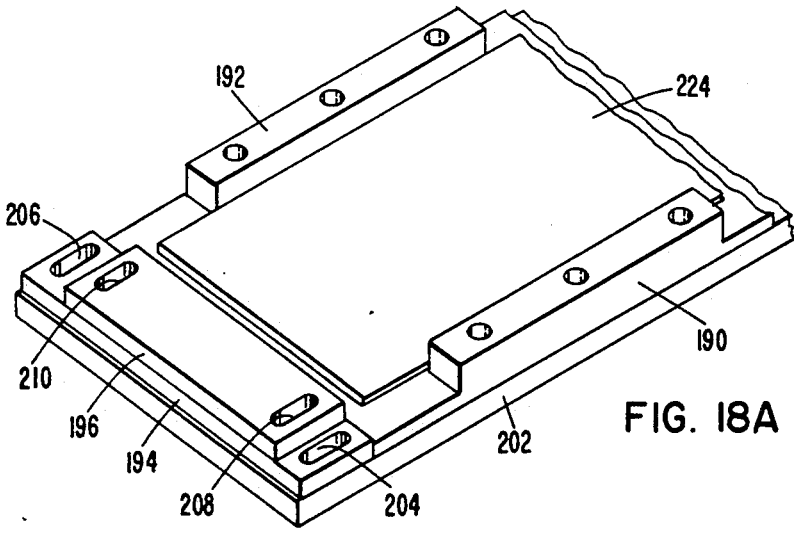
Figure 18B:
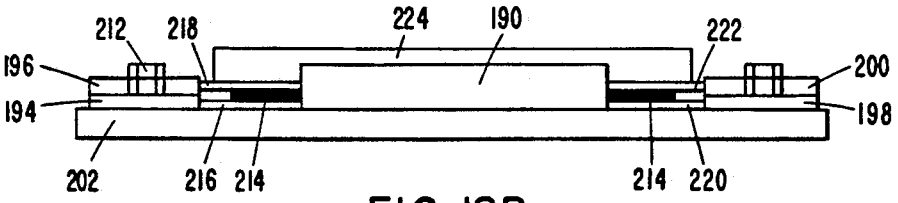

FIG. 18 (A) and (B) depict the tabbing mold assembly having side rails 190, 192, adjustable end rails 194, 196 and 198, 200 and base plate 202. Adjustable end rail 194 has slots 204, 206 and adjustable end rail 196 has slots 208, 210. Bolts such as bolt 212 fits in each of slots 204, 206, 208 and 210 to allow end rails 194, 196, 198, 200 to slip fore and aft in aligning the test specimen. The test specimen, see in FIG. 18 (B) as 214 has tabs 216, 218, 220 and 222 which are under caul plate 224.

4. MATERIALS AND EQUIPMENT

| Materials | Description |
|---|---|
| 3501-5A Resin | Hercules, Epoxy Resin (HS-SG-575) |
| MY-720 | Ciba-Geigy, tetraglycidyl methylene dianiline |
| DDS | Ciba-Geigy bis(para amino phenyl) sulfone |
| $BF_3MEA$ | Harshaw Chemical Baron Trifluoride monoethanolamine |
| Dichloromethane | ($MeCl_2$) MIL-D-6998 |
| Scotchbrite | 3M Company |
| Tracer yarn | 190 Denier Kevlar Roving |
| Plastic sheet | ⅛" thick |
| Chlorobenzene | ACS Reagent Grade |
| High temperature sealant | Schnee Morhead |
| Release film | Teflon, nonperforated, 0.001 to 0.004 inch thick |
| Cork dam | Cork ⅛" by 1" with pressure sensitive adhesive backing (Corprene) (or equivalent). |
| Tape | Pressure sensitive, green polyester silicone 1" and 2" |

-continued

| | |
|---|---|
| Air bleeder | Style 1581 Fiberglass or equivalent |
| Vacuum bag | Film, Capran 80 High Temp. nylon 0.002 inch |
| Masking tape | 2" wide and 1" wide |
| Sand paper | 100 and 320 grit |
| Adhesive | American Cyanamid, FM-123-2 .05#/ft$^2$ |
| Fiberglass tabbing plates | 7 ply, 0.065", Scotchply 1002 |
| Adhesive | Eastman 910, Eastman Chemical Products (HS-CP-150) |
| Strain gages | SR-4, FAE-12S-12S13, BLH Electronics, Inc. |
| Solder | 0.020 Energized resin core F, Alpha Metals Inc. |
| Peel ply | Release fabric ply B, Airtech |
| MEK | ACS reagent grade |
| Nitrogen | Compressed, 180 psi min. |
| Wire | 1101 3/C #32 7/40 DVE cond. twisted, Alpha Wire Corp. |
| Filter paper | Whatman No. 41 |
| Alcohol | ACS Reagent Grade |
| Ether | ACS Reagent Grade |
| Acetone | ACS Reagent Grade |
| Gage Kote | #'s 1, 2, 3, and 4 kit, Wm. T. Beam Co. |
| Emery Cloth | No. 220 Grit |
| Transparent tape | Scotch type ½" |
| Teflon tape | ½" |
| $H_2O$ | Distilled |

| Equipment | Description |
|---|---|
| Grit Blaster | |
| Thermocouple | Iron-Constantan No. 30 or equivalent |
| Thermocouple readout | Any standard millivolt recorder |
| Platen press | Wabash hydraulic press, Model 20-12 2TMB, 800° F. maximum temperature or equivalent |
| Saw | Micromatic - precision wafering or equivalent |
| Ohmmeter | Fluke Model #810 or equivalent |
| Soldering iron | Small tip 115 volt, 25 watt or equivalent |
| Base plate | Aluminum, ¼ to ½" thick |
| Caul plate | Aluminum, .080" thick |
| Knives | X-acto type and single edge razor blade |
| Beakers | 250 ml |
| Flask | 250 ml Erlenmeyer |
| Pycnometer | Hubbard type, or equivalent |
| Pycnometer | Side arm, 50 ml |
| Forced air oven | Blue M Power-P-Matic 60 (Blue M Electric Co.) Blue Island, Illinois, or equivalent. |
| Oven | Vacuum, capable, 85° C. |
| Balance | Analytical balance, Mettler B-5, or equivalent |
| Vacuum desiccator | Pyrex, A. H. Thomas catalog no. 4443, or equivalent |
| Vacuum source | Water aspirator or air pump, A. H. Thomas catalog no. 1038-B, or equivalent |
| Centrifuge | International Clinic Centrifuge Model CL, or equivalent |
| Constant temperature bath | Capable of maintaining 25° ± 0.01° C. (77° ± 0.2° F.) |
| Thermometer | Graduated in 0.1° C. subdivisions |
| Tensile tester | Instron, floor model, or equivalent |
| Wire coil | 1" long, 18 gage copper wire, ¼" inside diameter |
| Suspending wire | Stainless 300 series, .008" diameter |
| Platform | Aluminum, 4½" × 4" approximately two 1" ends bent 90° |
| Autoclave | Capable of a programmed heat rate ±2° F. to 400° F., minimum vacuum holding of 23" Hg in part with simultaneous autoclave pressure of 100 +10, −0 psi. Capable of maintaining 400° ± 5° F. |
| Vacuum tube | Minimum of 8" × ¼" copper tube with ¼" tube fitting on one end. Air bleed wrapped around the last 2½" of end of tube. |
| Ballpoint micrometer | IKL .0001 display, model #1-645-2P, or equivalent |
| Fixture | Drilling, 3/16 bushing |
| Fixture | Tabbing, 6" wide |

TEST PROCEDURES 5.1 Weight per Unit Length Determination. Determination of the weight per unit length of the tow shall be in accordance with the following:

a. Select a test length of fiber by pulling the tow off the spool in such a manner so as to prevent any side slippage of the tow as it is pulled off the spool. Smooth and collimate fiber specimen with gentle action of the fingers.

b. Cut tows into 48" (nominal) lengths. A minimum of one (1) specimen is required per spool.

c. Measure the actual length of each piece of tow to the nearest 1/32".

d. Weigh each piece of tow to the nearest 0.1 milligram e. Calculation: Weight per unit length (yds./lb.)

$$L_f = \frac{B(12.6)}{W_d}$$

or for sized tow:

$$L_f = \frac{B(12.6)}{W_s} \times \frac{100}{100\%\ \text{size}}$$

Where:

$W_d$=weight of each specimen of unsized tow, g.

$W_s$=weight of each specimen of sized tow, g.

B=length of each specimen, inches

% size=weight percent size from 5.2.

To convert length/wt. yds./lb. weight/length lbs./inch:

$L_w = 0.0278/L_f$ f. Record the required value of each tow specimen.

5.2 Sizing Content. The sizing content of the fiber shall be determined as follows:

a. Weigh 2 to 3 grams (g) of fiber to nearest 0.1 milligrams (mg).

b. Place specimen in 250 milliliter (ml) Erlenmeyer flask, and add 100 to 125 ml of methylene chloride.

c. Place rubber stopper on flask, and shake flask gently for approximately 3 minutes.

d. Decant methylene chloride, being careful not to lose any fiber.

e. Repeat steps b, c, and d, two additional times.

f. Remove specimen from flask.

g. Place specimen in oven for minimum of 15 minutes at 177±5 degrees Celsius (°C).
h. Remove specimen from oven, cool to room temperature, and weigh to nearest 0.1 mg.
i. Calculate sizing content as follows:

$$\text{Percent sizing} = \frac{W_1 - W_2}{W_1} \times (100)$$

Where:
$W_1$=original weight of sample, g.
$W_2$=weight of sample after removal of sizing, g.

5.3 Determination of Tow Density. (Shall be determined by Method A or B)

5.3.1 Method A, density by immersion of chlorobenzene.

a. Determine the density of the chlorobenzene with a side arm pcynometer. Record density. Rerun density about once a week or when the density of the chlorobenzene is suspected to have changed.
b. Weigh saddle in air. Record weight.
c. Weigh the saddle immersed in chlorobenzene. Record weight.
d. Roll masking tape around end of a fiber tow. Do the same to the other end of the tow sample. A tow sample four to five inches is desirable.
e. If the sample has been exposed to unusually high humidity or contains more than 2 percent moisture, place the sample in a 85° C. vacuum oven and pull a vacuum for one hour.
f. Remove sample from oven and thread the tow through the inside diameter of the saddle. Cut tow at both ends with a razor blade so that the center bore of the saddle contains the sample.
g. Weigh saddle and sample in air. The sample, itself, should weigh between 0.2 to 0.3 g. Record weight.

NOTE: ASSURE THAT DURING THE PRIOR TWO STEPS, THE FIBER DOES NOT PICK UP AN APPRECIABLE AMOUNT OF WATER, I.E., MORE THAN TWO PERCENT. THIS IS BEST ACCOMPLISHED BY MAINTAINING ROOM RELATIVE HUMIDITY LOW AND PERFORMING THESE TWO STEPS RAPIDLY. AS AN ALTERNATIVE, PLACE SAMPLES IN SADDLE AND THEN DRY BOTH TOGETHER AT 85° C. UNDER VACUUM FOR ONE HOUR. COOL IN A DESICCATOR AND PROCEED.

h. Place the saddle and sample in a 250 ml beaker containing chlorobenzene.
i. Place the beaker, saddle, and sample in a vacuum desiccator. Pull vacuum until no air is entrapped in the sample. It is essential that all air be removed from the sample.
j. Remove beaker, saddle, and sample, and place in a constant temperature bath for 20 minutes or until the chlorobenzene is 23° C.+0.1° C. Check chlorobenzene with a thermometer.
k. Remove from bath and suspend sample from balance beam while chlorobenzene rests on Al platform. Record weight.

$$\text{l. Calculation: } p = \frac{(B - C)A}{(B - C) - (D - E)}$$

Where:
A=density of chlorobenzene, g/cc.
B=weight of sample and saddle in air, g.
C=weight of saddle in air, g.
D=weight of sample and saddle in chlorobenzene, g.
E=weight of saddle in chlorobenzene, g.
P=density of fiber, g/cc.

NOTE: FILTER CHLOROBENZENE OCCASIONALLY THROUGH WHATMAN NO. 41 FILTER PAPER TO REMOVE LOOSE FIBERS.

WEIGHTS SHOULD BE TAKEN TO THE NEAREST 0.1 mg. SIZING MUST BE REMOVED FROM TOW PRIOR TO DENSITY MEASUREMENT.

5.3.2 Method B, density by water pycnometer.

5.3.2.1 Calibration of pycnometer. The pycnometer shall be calibrated as follows:

a. Clean the pycnometer thoroughly using sodium dichromate cleaning solution.
b. Dry the interior by rinsing it successively with tap water, distilled water, and either alcohol and ether or acetone.
c. Expel the solvent vapors with a current of air which has been passed through absorbent cotton and Drierite. Do not subject pycnometer to any considerable elevation of temperature.
d. Prior to weighing, wipe the entire pycnometer first with a piece of clean moist cloth and then with a dry cloth. Weigh the empty pycnometer immediately.
e. Carefully fill the pycnometer with freshly boiled distilled water which is slightly below the temperature of the bath.
f. Insert the pycnometer plug with a rotary motion to avoid the inclusion of air bubbles and then twist until it seats firmly but not so tight that it locks.
g. Place the pycnometer in a constant temperature bath maintained at 25.0° ±0.1° C. Leave the pycnometer in the bath at least 30 minutes.
h. Check the bath to be certain the temperature has not changed. Then remove the pycnometer from the bath and wipe the excess water from the top of the plug using one stroke of the hand or finger.
i. Wipe the surface of the pycnometer with absorbent material giving special attention to the joint where the plug enters the pycnometer.
j. At this point, examine the pycnometer to be certain that it is entirely filled with water. (If any air bubbles are present, fill the pycnometer again and replace it in the bath.)
k. Remove the pycnometer from the bath and wipe the entire surface with a piece of clean moist cloth and then with a dry cloth. Special attention should be given to the area around the joint where the plug enters the pycnometer. Weigh the pycnometer immediately.

5.3.2.2 Density determination. The density of the tow shall be determined as follows:

NOTE: SIZING MUST BE REMOVED FROM SIZED TOW PRIOR TO THE DENSITY DETERMINATION.

a. Accurately weigh enough of the sample into the pycnometer to fill the pycnometer approximately one-third full (approximately 2 gram sample).
b. Carefully fill the pycnometer with boiled, distilled water. Place the pycnometer in a beaker within a vacuum dessicator. Evacuate until the water boils. Release the vacuum and again evacuate until bubbles appear, then seal the desiccator and leave the samples under vacuum for 5 minutes.

c. Remove the pycnometer from the desiccator. If necessary, add more boiled, distilled water and centrifuge the pycnometer for 5 to 10 minutes.
d. Insert the pycnometer plug such as to avoid the inclusion of air bubbles, then twist until the plug seats firmly but not so tight that it locks.
e. Place the pycnometer in a beaker filled with boiled, distilled water such that the pycnometer is submerged.
f. Place the beaker containing the pycnometer in a constant temperature bath maintained at 25.0° C. ±0.1° C. Keep the beaker covered with a watch glass.
g. Leave the pycnometer in the bath at least 30 minutes. After 30 minutes, the pycnometer may be removed from the bath for weighing if the temperature has not changed for 10 minutes or if the fluctuation has been less than 0.1° C. (0.1° F.).
h. Remove the pycnometer from the bath and wipe the excess water from the top of the top of the plug using one stroke of the hand or finger. Wipe the surface of the pycnometer with absorbent material with special attention given to the joint where the plug enters the pycnometer. Weigh the pycnometer immediately.
i Calculation:

$$\text{Tow density (lb/in.}^3\text{) at } T\,^\circ\text{C.} = \frac{A \times E}{A + B - D} \times 0.0361$$

Where:
A=weight of sample, g.
B=weight of pycnometer plus water, g.
D=weight of pycnometer plus water plus sample, g.
T=temperature of bath. Unless otherwise stated, maintain bath at 25° C. ±0.1° C.
E=density of water at temperature T°C. Unless otherwise stated, T°C. shall be 25° C. and the density (E) is 0.9971 g/ml.

5.4 Twist Test. This test is used to determine the number of twists per inch of the carbon fiber tow.
a. Remove any frayed surface fiber from the package to be tested.
b. Attach free end of carbon fiber spool to the fixed clamp on the top of the "U" frame. While holding the fiber package horizontal.
c. Unspool the fiber from the package while keeping the package horizontal. (Do not twist the package while unspooling.) Rest package on the base of the "U" frame.
d. Attach the free clamp directly under the 36" wire. (Do not cut sample free from package.)
e. Insert a fine, pointed, polished stylus into the center of the sample at the top fixed clamp.
f. Draw the stylus down the sample, splitting the tow to the 36" wire. (Watch for rotation of the movable clamp.)
g. Hold stylus at the 36" wire, cut fiber from spool below the movable clamp. Count the number of rotations of the movable clamp.
h. Twist/in=number of rotations of movable clamp/36. Report to 2 significant digits. Example=1.5 rotations/36 in.=0.04 tpi.

5.5 Tensile Strength, Modulus, and Short Beam Shear Determination.

5.5.1 Prepreg. Samples selected from the lot shall be converted to prepreg using 3501-5A resin. Prepreg fiber areal weight shall be 0.0315±0.00084 lbs/ft$^2$. Prepreg resin content shall be 35±3%. Prepreg will include a Kevlar tracer yarn located 0.25±0.10" from either edge. In lieu of 3501-5A, combine 100 parts by weight MY-720, 36.75 parts by weight DDS and 0.5 parts by weight $BF_3$MEA such that the epoxy to diamine functionality ratio is 1:0.75.

SAFETY NOTE: WEAR GLOVES WHEN HANDLING RESIN, PREPREG OR ANY RESIN RELATED PRODUCT WHEN EXPOSED FOR GREATER THAN 5 MINUTES ACCUMULATED TIME PER 8 HOURS.

5.5.2 Prepreg Test Procedure.

5.5.2.1 Prepreg resin content, areal weight, and laminate fiber volume. The fiber volume of the laminate shall be determined as follows:
a. Cut 12.000±0.030 inches of 3" tape.
b. Weigh cut tape to nearest 0.0001 grams ($W_1$)
c. Place prepreg and 100 ml methylene chloride in 250 ml Erlemeyer flask.
d. Place stopper in flask.
e. Place flask on shaker and shake 1 minute minimum.
f. Decant solvent off.
g. Repeat steps c through f two additional times.
h. Dry in oven at 177°±10° C. for 15 minutes.
i. Remove from oven and allow sample to cool.
j. Reweigh sample to nearest 0.0001 gram ($W_2$).
k. Calculate as follows:

$$\text{Resin content, (\%)} = \frac{W_1 - W_2}{W_1} \times 100$$

Prepreg areal weight (lb/ft$^2$) $^{A}w = {}^{W}2 \times 0.0088$ $$\text{Fiber volume, (\%) } F_v = \frac{T_f \times 100}{T_p}$$

Where:
$W_1$=weight of 36 in.$^2$ of prepreg, g.
$T_f$=fiber thickness/ply, (inches)
$T_p$=cured ply thickness of prepreg measured from panel (inches)
$W_2$=fiber weight from prepreg, g.
$F_v$=fiber volume (%)
$A_w$=prepreg areal weight, (lb/ft$^2$)
pf=fiber density, (lb/in.$^3$)

5.5.3 Test panel preparation FM 123-2. Test specimens shall be prepared for testing per the following requirements.
a. The panel tensile and shear shall be layed up for cure as shown in FIG. 13, as described.
b. The cure cycle is as follows:
(1) Place vacuum bagged layup in autoclave and close autoclave.
(2) Apply minimum vacuum of 23 inches Hg.
(3) At a rate of 3° to 5° F. per minute, raise the laminate temperature to 350°±5° F. During the heat up, apply 85+10, −0 psi when the laminate temperature reaches 275°±5° F.
(4) Hold at 23 inches Hg (minimum), 85±10, −0 psi, and 350°±5° F. for 60 +5 minutes.
(5) At a rate of 13°±2° F. per minute, lower laminate temperature to 150°±5° F.
(6) Release autoclave vacuum and pressure.
(7) Remove layup from autoclave.
(8) Remove panel from vacuum bag.

5.5.4 Mechanical Test Procedures 5.5.4.1 Tensile strength and modulus test. The tensile strength and tensile modulus of elasticity of laminates shall be determined in accordance with the following:

5.5.4.1.1 Tensile panel tabbing. End tabs shall be applied to tensile panels as follows:

5.5.4.1.2 Preparing the panel.

a. Trim ¼" off one end of 10" panel length.

b. Cut other end of panel to a length of 9.0±0.1"

c. True up edges of panel, so panel will fit into tab mold. Make sure there are no high edges that will interfere with the seating of the end tabs.

d. Remove peel ply from both sides approximately 2¼" back from each end, Leave peel ply attached in center.

NOTE: IF TWO 3×10 PANELS ARE BEING BONDED AT THE SAME TIME, TAPE PANELS TOGETHER BY PLACING A STRIP OF 1" GREEN TAPE LENGTHWISE (BOTH SIDES) ON CENTER PEEL PLY SURFACE ONLY.

e. Determine the mid-point between ends, then measure out 2.75 inches each way and draw parallel lines that are transverse to 9" dimension. This will allow equal spacing on the ends and maintain the 5.5 inch spacing of the end tabs.

f. Wash panel ends by flooding with MEK solvent applied from a squeeze bottle.

g. Allow the panel to air dry while preparing end tabs for bonding.

5.5.4.1.3 Preparation of tabs for room temperature tests using FM-123-2 a. Remove FM-123-2 adhesive from freezer and allow to warm to room temperature.

b. Cut fiberglass tab plates so that width is 4 inches for a 3 inch panel and 7 inches for a 6 inch panel.

c. Grit blast the flat tab surface uniformly until no gloss remains.

d. Degrease thoroughly by scrubbing with MEK wet cloths until a clean cloth no longer shows a residue. Then rinse surface by flooding with MEK. Air dry 15 minutes minimum before using.

e. Then place prepared surface down on a sheet of FM-123-2. Press down firmly with thumb to make good contact between tab and resin. Trim closely around tab with a sharp knife. Care should be taken not to contaminate the resin during handling.

f. Place bottom tabs into position in fixture, aligning beveled edges with ends of the side bars. Hold in position by positioning the bottom mold end plate snugly along the backside of the tab and tighten outside screws.

g. Remove release paper from bottom tabs then position the panel over the tabs aligning the index marks with the ends of the side bars. Press panel firmly onto tab adhesive.

h. Remove release paper from top tabs and place top tabs into position over panel, aligning beveled edge with ends of the side bars. Adjust top end plates snugly along the ends of the top tabs and tighten inside screws.

i. Assemble tabbing fixture pressure plate over tabs.

5.5.4.1.4 Press cure cycle.

a. Place mold assembly into press preheated to 250° F.

b. Apply pressure of 40 to 50 pounds per square inch calculated for actual bond area. Maintain this pressure throughout cure cycle.

CAUTION

THIS IS NOT GAGE PRESSURE. VALUE FOR GAGE PRESSURE MUST BE CALCULATED FOR EACH PRESS.

c. Cure for 1 hour.

d. Cool press platens while maintaining pressure to a temperature below 150° F.

e. Remove pressure and remove mold assembly.

f. Cut the test specimens to the configuration shown in FIG. 15.

5.5.4.1.4.1 Test specimen preparation. The specimen shall be cut from laminate panels in accordance with the following:

a. Set up the panel cutting machine to accept the diamond cutting wheel.

NOTE: MACHINE SET UP SHOULD BE DONE ONLY BY QUALIFIED PERSONS. THIS MAY OR MAY NOT BE THE OPERATOR WHO CUTS THE PANELS.

b. Clean indexing table surface until free of dirt and water.

c. Take a piece of ⅛" thick plastic sheet, larger than the panel to be cut, and fasten to the indexing table with double-faced masking tape.

d. Adjust the cutting wheel to make a 1/32 to 1/16 inch cut in the plastic sheet.

e. Apply double-faced masking tape on one side of the laminate panel to be cut (tape in tab area).

f. Place the panel on a cut-free surface of the plastic sheet on the indexing table, aligning the panel with tracer yarn to ensure that machine cuts will be 90°, 0°±0.25° to the unidirectional orientation of the fiber.

g. Trim ⅛ inch from each side.

h. Index table to provide proper width of specimen and cut. Be sure to allow for the width of the diamond cutting wheel in indexing for all cuts.

i. Repeat process to obtain required test specimens.

j. Machine spindle speed for cutting shall be 1100 to 4200 rpm.

k. Use feed rate of 1 to 3 feet per minute.

l. Use water liberally as a collant during cutting unless otherwise directed.

NOTE: AFTER CLEANING, THE FINISHED TEST SPECIMENS SHOULD HAVE SMOOTH SHARP CUT EDGES, SQUARE CORNERS, AND SQUARE EDGES WITH NO TAPERS OR FEATHERED EDGES. FEATHERED EDGES CAN BE PREVENTED BY HAVING THE DIAMOND WHEEL EXTEND APPROXIMATELY 1/32 TO 1/16 INCH BELOW THE PANEL DURING CUTTING.

5.5.4.1.5 Drilling holes in tabs.

a. Place tabbed and cut test specimen in drilling fixture. Tighten sides down to ensure proper alignment.

b. Using 3/16" carbide tipped bit, drill through tabbing material.

5.5.4.1.6 Application of Strain Gages. Strain gages shall be applied to test specimens in accordance with the following:

5.5.4.1.7 Preparation of specimen surface.

a. Remove remaining peel ply from both sides of specimen, then, using 220 grit emery cloth, sand area in which strain gage is to be located just enough to smooth the surface.

b. Thoroughly degrease the area with MEK.

c. Using a cotton swab soaked in a neutralizer, wipe sanded area in one direction. Using gauze or cheesecloth, wipe off neutralizer.
d. Using a pencil, mark centering lines for location of gage.

5.5.4.1.8 Application of gage.

a. Remove gage from package. Do not touch surface of gage which is to be bonded.
b. Using a strip of transparent tape, touch top of gage so that it adheres to the tape. The tape will be used to transfer the gage to the specimen.
c. Apply a thin coat of Eastman 910 catalyst to the gage only and allow to dry.
d. Set gage on specimen, aligning with pencil centering lines and rub tape down.
e. Peel back one end of the transparent tape so that the gage is pulled back and is not touching specimen.
f. Apply just enough Eastman 910 to form a bead at the junction of the tape still adhering to the specimen and the specimen.
g. Place thumb on secured end of tape and push forward rolling the gage onto the specimen.
h. Use finger pressure to hold gage against specimen for a minimum of one minute. Allow to dry 2 to 3 minutes.
i. Remove transparent tape slowly at a 180° peel angle to ensure gage will not lift off.
j. Remove excess adhesive with an X-acto knife.

5.5.4.1.9 Connecting lead wires.

a. Lead wire should be approximately 13 inches in length and soldered and trimmed both ends.
b. Bend the end of the wire that is to be connected to the gage into the shape shown in FIG. 16A.
c. Put a small amount of flux onto gage tabs and solder a small dot of solder onto each tab.
d. Holding lead wire down on top of the solder dot, touch iron on wire. This will solder the lead to the tab. Repeat for the other lead.
e. Remove any flux left with a cotton swab or soft brush soaked in MEK.
f. Using ½" tape, fold a loop in the wire and tape it down ¼" from gage.
g. Apply one coat of Gagekote and allow to dry.
h. Trim excess Gagekote from sides of specimen
i. Check resistance using an ohmmeter.
j. Each specimen shall be visually and dimensionally inspected prior to testing Any flaws or irregularities in fiber orientation, fiber spacing, etc., are to be recorded as part of the test data. Use a suitable ball type micrometer reading to at least 0.001 inch to measure specimen Use minimum measurements of each specimen for calculating values.

5.5.5 Strain Gage Calibration. Each strain gage attached to the specimen must be calibrated prior to running the test. The gages are actually fine wire which stretch or compress with the specimen and thus increase or decrease in diameter. This changes the electrical resistance of the wire, and when calibrated, can be related to strain in the gage by changing one of the normally constant resistors in the measurement system a known amount. By interpreting this resistance change as though it were occuring at the strain gage, calculations can be made to determine the amount of strain the resistance change represents. The exact procedure is as follows:

a. A 10,000 ohm resistor will be used for shunt calibration.
b. Determine the elongation range needed for practical strain measurement by noting the expected elongation at failure. Note also the gage factor and resistance of the gage.
c. Convert this expected elongation at failure to strain in inches per inch by dividing by 100.

$$R_{cal} = \text{selected calibration resistance, ohms} = 10{,}000$$

Where:

$R_g$=gage resistance, ohms (given)

N=number of active arms (variable resistors). This will normally be one (1), the resistance gage.

GF=gage factors (given)

$$\frac{\Delta L}{L} = \text{selected strain, inches per inch (\% expected elongation divided by 100)}$$

d. From the formula below, determine the strain that this selected resistance represents:

$$\frac{\Delta L}{L} = \frac{R_g}{N\,(GF)\,R_{cal}}$$

e. Set the recorder pen to read this strain directly on chart. Thus, if the calculated strain is 0.00126 inches per inch (0.126%), then pen is set to 1.26 inches on the chart. A one inch deflection on the chart would then represent a 0.001 inch/inch strain and a direct readout of strain is possible.
f. It may be in some cases desirable to set the pen at some multiple of the calculated strain. For a 0.00126 inch per inch calculated strain, the pen may be set to 2.52 inches on the chart. Then the direct readout would be such that a two inch deflection would represent a 0.001 inch/inch strain.
g. Repeat the calibration for each gage on the sample.
h. When no gages are attached to the sample, this calibration of strain does not apply.

5.5.5.1 Longitudinal tensile test. The 0° tensile test procedure shall be as follows:

a. Mount the test specimen (see FIG. 15) into the modified Instron grips as shown in FIG. 16. Manually lower the crosshead until the Instron grips contact the specimen Allow the specimen to align itself by the self-tightening action of the Instron grips.
b. The crosshead speed shall be 0.5 inch/minute unless otherwise specified.

5.5.5.2 Tensile strength. Calculate the tensile strength of the 0° laminate specimens as follows (see FIG. 17):

$$\text{Tensile strength, psi} = \frac{\text{maximum load, lbs.}}{\text{cross sectional area, in}^2}$$

5.5.5.3 Elongation at failure. The elongation at failure is read directly from the axial strain gage curve at the point of failure and reported as percentage (see FIG. 17).

% elongation=reading at failure from axial strain gage curve.

5.5.5.4 Tensile modulus of elasticity. Determine the tensile modulus as follows:

a. Construct a line tangent to the axial strain gage curve at 0.4% strain (see FIG. 17).

b. Determine the load at 0.4% strain on the chart and calculate the slope of the line.

$$\text{Slope of load displacement (See FIG. 17)} = \frac{\text{load at 0.4\% strain, lbs.}}{B' \text{ inches/inch}}$$

c. Use this value to calculate the tensile modulus as follows:

$$\text{Tensile modulus, psi} = \frac{\text{slope of load displacement, lbs.}}{\text{cross sectional area, in}^2}$$

d. Tensile strength and modulus shall be normalized to 100% fiber volume by dividing numbers obtained by fiber fraction in the panel.

5.5.5.5 Short Beam Shear Strength. The short beam shear strength of the laminates shall be determined in accordance with the following:

5.5.5.6 Test specimens. Test specimens shall be prepared in accordance with the following:

a. Cut specimens to finished dimensions from unidirectional laminates with plies parallel to the longitudinal axis.

b. Each specimen shall be visually and dimensionally inspected prior to testing. A suitable ball type micrometer reading to at least 0.001 inch shall be used. Any flaws or irregularities in fiber orientation, fiber spacing, etc., are to be recorded as part of the test data. Use minimum measurements of each specimen for calculating values.

c. Specimen shall be 0.080 nominal thick, 0.250±0.005" wide, 0.60±0.05" long.

5.5.5.7 Short beam shear test. The short beam shear test procedure shall be as follows:

a. Set the crosshead speed at 0.05 inch/minute unless otherwise specified.

b. Adjust the support noses to a span 4 times the average specimen thickness for the lot being tested unless otherwise specified. Span is to be measured with a rule.

c. The loading nose shall have a 0.250 inch diameter and support noses shall have a 0.125 inch diameter unless otherwise specified. Run test at 77°±5° F.

d. Using forceps, install the specimen in the test fixture on the support noses. Align the specimen by pushing specimen back until it rests against the rear stops on the support noses, and center it on the two noses.

e. Operate the machine to specimen failure according to the Instron Instructions manual.

f. Calculate the short beam shear strength at failure as follows:

$$A = \frac{3p}{4bt}$$

Where:

A=short beam shear stress, psi p=total load at failure, lbs.

b=specimen width, in.

t=specimen thickness, in.

What is claimed is:

1. Polyacrylonitrile-based carbon fiber in the form of a filament bundle characterized by Modulus and Tensile Strength in the Impregnated Strand Test respectively between about 42 million and 50 million psi and between about 600,000 and 900,000 psi, and Short Beam Shear Strength between about 15,000 and 19,000 psi in the Laminate Test, and wherein said carbon fiber has been electrolytically surface treated at 0.5 columns per inch per approximate 12,000 filaments.

2. Carbon fiber characterized by Modulus and Tensile Strength in the Impregnated Strand Test respectively between about 42 million and 50 million psi and 600,000 and 900,000 psi, Short Beam Shear Strength in the Laminate Test between about 15,000 and 19,000 psi, density between about 1.65 and 1.80 grams per cubic centimeter and a mean filament area between about 15.8 and 33.3 square microns with a coefficient of variation of about 5% or less, and wherein said carbon fiber has been electrolytically surface treated at 0.5 columbs per inch per approximate 12,000 filaments.

* * * * *